US011253111B2

(12) United States Patent
Casper et al.

(10) Patent No.: US 11,253,111 B2
(45) Date of Patent: Feb. 22, 2022

(54) SKIN CARE PRODUCT DISPENSERS AND ASSOCIATED SELF-FOAMING COMPOSITIONS

(71) Applicant: GPCP IP Holdings LLC, Atlanta, GA (US)

(72) Inventors: Ted Allen Casper, Kaukauna, WI (US); Benjamin John Holtz, Appleton, WI (US); Ryan David Carignan, Suamico, WI (US); Brian Patrick Argo, Greenville, WI (US); Jeffrey Charles Duhacek, Neenah, WI (US); Philip Ross Walker, Oshkosh, WI (US); Darryl Tyler Rathbun, Atlanta, GA (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 16/999,312

(22) Filed: Aug. 21, 2020

(65) Prior Publication Data

US 2021/0052115 A1 Feb. 25, 2021

Related U.S. Application Data

(60) Provisional application No. 62/890,193, filed on Aug. 22, 2019.

(51) Int. Cl.
*A47K 5/12* (2006.01)
*B65D 83/48* (2006.01)

(52) U.S. Cl.
CPC ..... *A47K 5/1217* (2013.01); *A47K 5/1211* (2013.01); *B65D 83/48* (2013.01)

(58) Field of Classification Search
CPC .... B65D 83/48; B65D 83/756; B65D 83/207; B65D 83/682
USPC .... 222/61, 63, 52, 56, 190, 401, 402, 402.1, 222/402.21–402.25, 635
See application file for complete search history.

(56) References Cited

U.S. PATENT DOCUMENTS

| | | | |
|---|---|---|---|
| 2,908,650 | A | 10/1959 | Fine |
| 3,959,160 | A | 5/1976 | Horsier et al. |
| 4,405,489 | A | 9/1983 | Sisbarro |

(Continued)

FOREIGN PATENT DOCUMENTS

| | | |
|---|---|---|
| CA | 2170445 | 8/1996 |
| CA | 2687140 C | 7/2013 |

(Continued)

OTHER PUBLICATIONS https://www.lindalgroup.com website accessed Oct. 2, 2020.

*Primary Examiner* — Lien M Ngo
(74) *Attorney, Agent, or Firm* — Nelson Mullins Riley & Scarborough LLP

(57) ABSTRACT

Embodiments of the present invention provide foam skin care product (e.g., soap) dispensers and corresponding compositions. An example foam skin care product dispenser includes a reservoir that holds, under pressure, a skin care product composition, including one or more propellants. During a dispense, a dispense valve is opened to release some of the skin care product composition from the reservoir into a dispensing (e.g., flow) path. Once released, the skin care product composition at least partially foams to form foamed skin care product (e.g., foamed soap).

16 Claims, 14 Drawing Sheets

(56) References Cited

U.S. PATENT DOCUMENTS 5,002,680 A 3/1991 Schmidt et al.
5,014,887 A 5/1991 Kopp
5,230,648 A 7/1993 Kelley et al.
5,305,930 A 4/1994 De Laforcade
5,334,325 A 8/1994 Chaussee
5,451,396 A 9/1995 Villars
5,496,538 A 3/1996 Zimmerman et al.
5,602,091 A 2/1997 Monson et al.
5,902,225 A 5/1999 Monson
6,021,926 A 2/2000 Lauwers et al.
6,177,092 B1 1/2001 Lentini et al.
6,276,565 B1 8/2001 Parsons et al.
6,333,362 B1 12/2001 Lorant
6,407,044 B2 6/2002 Dixon
6,440,912 B2 8/2002 McGee et al.
6,467,651 B1 10/2002 Muderlak et al.
6,607,106 B2 8/2003 Henry et al.
6,620,855 B2 9/2003 Lorant
6,682,726 B2 1/2004 Marches et al.
6,929,150 B2 8/2005 Muderlak et al.
6,971,557 B2 12/2005 Mather et al.
7,104,424 B2 9/2006 Kolanus
7,320,418 B2 1/2008 Sassoon
7,374,066 B2 5/2008 Jackson et al.
7,407,065 B2 8/2008 Hooks et al.
7,455,197 B2 11/2008 Ophardt
7,464,839 B2 12/2008 Heukamp
7,485,609 B2 2/2009 Reddy et al.
7,488,709 B2 2/2009 Ribery et al.
7,533,787 B2 5/2009 Muderlak et al.
7,540,397 B2 6/2009 Muderlak et al.
7,582,242 B2 9/2009 Koianus
7,651,014 B2 1/2010 Neuhaus et al.
7,681,765 B2 3/2010 Muderlak
7,823,751 B2 11/2010 Ophardt et al.
7,851,423 B2 12/2010 Ruppert et al.
7,874,299 B2 1/2011 de la Guardia et al.
7,878,371 B2 2/2011 Sassoon
7,939,480 B2 5/2011 Hall et al.
8,074,848 B2 12/2011 Pittl et al.
8,087,545 B2 1/2012 Ciavarella et al.
8,146,782 B2 4/2012 Gross et al.
8,342,365 B2 1/2013 Snodgrass
8,371,481 B2 2/2013 Kopp
8,418,996 B2 4/2013 Rideg
8,480,967 B2 7/2013 Zlatic et al.
8,486,375 B2 7/2013 Tamarkin et al.
8,496,137 B2 7/2013 Alfaro et al.
8,544,696 B2 * 10/2013 Willemsen ..... B65D 83/262 222/181.3
8,555,698 B2 10/2013 Ciavarella et al.
8,616,417 B2 12/2013 Neuhaus
8,763,932 B2 7/2014 Niggemann
8,863,994 B2 10/2014 Neuhaus et al.
8,905,273 B2 12/2014 De Schrijver
8,940,674 B2 1/2015 Fernandez de Castro et al.
8,991,657 B2 3/2015 Ciavarella et al.
9,079,675 B2 * 7/2015 Vervoort ..... B65D 83/46
9,301,653 B2 4/2016 Ciavarella et al.
9,358,187 B2 6/2016 Samain et al.
9,427,118 B2 8/2016 Brouwer
9,504,361 B2 11/2016 Yates
9,527,656 B2 12/2016 Walters et al.
9,533,177 B2 1/2017 de la Guardia et al.
9,539,598 B2 1/2017 Ciavarella et al.
9,579,613 B2 2/2017 Fawcett et al.
9,586,217 B2 3/2017 Arminak
9,642,502 B2 5/2017 Harris et al.
9,655,479 B2 5/2017 Tederous et al.
9,687,121 B2 6/2017 Ciavarella et al.
9,700,182 B2 7/2017 Binderbauer et al.
9,737,177 B2 8/2017 Ciavarella et al.
9,758,296 B2 9/2017 Giordano et al.
9,776,787 B2 10/2017 Nakajima
10,000,728 B2 6/2018 Concalves Rodrigues
10,010,225 B2 7/2018 Little
10,065,199 B2 9/2018 Twaroski et al.
10,087,608 B2 10/2018 Dobizl et al.
10,259,643 B2 4/2019 Christianson
10,625,929 B2 4/2020 Bartolucci et al.
10,625,930 B2 4/2020 Takahashi et al.
10,653,590 B2 5/2020 Tones Rivera et al.
2002/0006883 A1 1/2002 Dixon
2002/0028182 A1 3/2002 Dawson et al.
2002/0045670 A1 4/2002 Lorant
2003/0026775 A1 2/2003 Marchesi et al.
2003/0083210 A1 5/2003 Goldberg et al.
2004/0251271 A1 * 12/2004 Jackson ..... A47K 5/1217 222/63
2004/0258627 A1 12/2004 Riedel et al.
2004/0258628 A1 12/2004 Riedel et al.
2005/0155980 A1 7/2005 Neuhalfen
2006/0147406 A1 7/2006 Yerby et al.
2007/0184995 A1 8/2007 Shah et al.
2007/0228082 A1 10/2007 Jasper et al.
2007/0289997 A1 12/2007 Lewis et al.
2009/0236254 A1 9/2009 Jenkins et al.
2009/0247444 A1 10/2009 Ruppert et al.
2013/0165530 A1 6/2013 Hillman et al.
2013/0244976 A1 9/2013 Inamoto et al.
2014/0017176 A1 * 1/2014 Huggins ..... A61K 8/35 424/43
2014/0172523 A1 * 6/2014 Stob ..... G06Q 30/0241 705/14.4
2014/0367490 A1 12/2014 Neuhalfen et al.
2016/0302624 A1 10/2016 Little
2017/0014006 A1 1/2017 Ciavarella et al.
2017/0252273 A1 9/2017 Renock et al.
2017/0340904 A1 11/2017 De la Guardia et al.
2018/0110690 A1 4/2018 Torres Rivera et al.
2018/0110694 A1 4/2018 Renock et al.
2018/0110710 A1 4/2018 Zhao et al.
2018/0236466 A1 8/2018 Laidler
2018/0280299 A1 10/2018 Buge et al.
2018/0304284 A1 10/2018 Ophardt et al.
2018/0353398 A1 12/2018 Torres Rivera et al.
2019/0014955 A1 1/2019 Babikian et al.
2019/0021960 A1 1/2019 Dippe et al.
2019/0046441 A1 2/2019 Buge et al.
2019/0105243 A1 4/2019 Song et al.
2019/0105244 A1 4/2019 Song et al.
2019/0105245 A1 4/2019 Song et al.
2019/0105246 A1 4/2019 Cochran et al.
2019/0105247 A1 4/2019 Song et al.
2019/0117527 A1 4/2019 Heffernan et al.
2019/0117537 A1 4/2019 Wei et al.
2019/0117543 A1 4/2019 Zhao et al.
2019/0117544 A1 4/2019 Zhao et al.
2019/0177074 A1 6/2019 Waugh
2019/0192405 A1 6/2019 Zhao et al.
2019/0240121 A1 8/2019 Torres Rivera et al.
2019/0283959 A1 9/2019 Rasel et al.
2019/0307297 A1 * 10/2019 Ciavarella ..... B05B 7/0031
2019/0307298 A1 10/2019 Zhao et al.
2019/0335958 A1 * 11/2019 Proper ..... A47K 5/14
2020/0000690 A1 1/2020 Renock et al.
2020/0055658 A1 * 2/2020 Casper ..... B01F 15/0445
2020/0140184 A1 5/2020 Laidler et al.
2020/0148458 A1 5/2020 Bartolucci et al.
2020/0148459 A1 5/2020 Bartolucci et al.
2020/0237628 A1 7/2020 Torres Rivera et al.

FOREIGN PATENT DOCUMENTS

CA 2899911 A1 2/2017
CN 108433604 A 8/2018
CN 109106261 A 1/2019
CN 110214001 A 9/2019
CN 111511652 A 8/2020
DE 3518627 A1 11/1986
DE 20301831 U1 5/2003
DE 10216502 A1 11/2003
DE 10255991 A1 6/2004
DE 10327433 A1 1/2005

(56) References Cited

FOREIGN PATENT DOCUMENTS

| | | | |
|---|---|---|---|
| DE | 102009001493 | A1 | 9/2010 |
| DE | 202017176684 | U1 | 11/2017 |
| EP | 0269831 | A2 | 6/1988 |
| EP | 0586295 | A1 | 3/1994 |
| EP | 0946129 | B1 | 10/1999 |
| EP | 1750561 | B1 | 2/2007 |
| EP | 2066285 | B1 | 6/2009 |
| FR | 3000673 | A1 | 7/2014 |
| GB | 748411 | | 5/1956 |
| GB | 1412282 | | 11/1975 |
| JP | H02-149511 | A | 6/1990 |
| JP | 2018058591 | A | 4/2018 |
| JP | 2018193080 | A | 12/2018 |
| KR | 20190100295 | A | 8/2019 |
| MX | PA06006723 | A | 8/2006 |
| WO | WO 94/02109 | | 2/1994 |
| WO | WO 96/11162 | | 4/1996 |
| WO | WO 97/03646 | A1 | 2/1997 |
| WO | WO 97/20626 | A1 | 6/1997 |
| WO | WO 98/27936 | | 7/1998 |
| WO | WO 98/27938 | | 7/1998 |
| WO | WO 99/38490 | | 8/1999 |
| WO | WO 2002/087520 | A1 | 11/2002 |
| WO | WO 2003/084501 | A1 | 10/2003 |
| WO | WO 2008/009539 | A1 | 1/2008 |
| WO | WO 2009/116016 | A2 | 9/2009 |
| WO | WO 2013/190465 | A2 | 12/2013 |
| WO | WO 2015/082918 | A1 | 6/2015 |
| WO | WO 2017/181963 | A1 | 10/2017 |
| WO | WO 2017/187124 | A1 | 11/2017 |
| WO | WO 2018/038686 | A1 | 3/2018 |
| WO | WO 2018/063112 | A1 | 4/2018 |
| WO | WO 2018/175510 | A1 | 9/2018 |
| WO | WO 2018/221420 | A1 | 12/2018 |
| WO | WO 2019/074989 | A1 | 4/2019 |
| WO | WO 2019/074990 | A1 | 4/2019 |
| WO | WO 2019/074991 | A1 | 4/2019 |
| WO | WO 2019/074992 | A1 | 4/2019 |
| WO | WO 2019/074993 | A1 | 4/2019 |
| WO | WO 2019/076697 | A1 | 4/2019 |
| WO | WO 2019/079409 | A1 | 4/2019 |
| WO | WO 2019/079693 | A1 | 4/2019 |
| WO | WO 2019/079696 | A1 | 4/2019 |
| WO | WO 2019/086823 | A1 | 5/2019 |
| WO | WO 2019/115706 | A1 | 6/2019 |
| WO | WO 2019/118423 | A1 | 6/2019 |
| WO | WO 2019/171563 | A1 | 9/2019 |
| WO | WO 2019/195640 | A1 | 10/2019 |
| WO | WO 2020/005309 | | 1/2020 |
| WO | WO 2020/030332 | A1 | 2/2020 |
| WO | WO 2020029223 | A1 | 2/2020 |
| WO | WO 2020/095235 | A1 | 5/2020 |
| WO | WO 2020/097273 | A1 | 5/2020 |
| WO | WO 2020/127759 | A1 | 6/2020 |
| WO | WO 2020/127891 | | 6/2020 |

* cited by examiner

SKIN CARE PRODUCT DISPENSERS AND ASSOCIATED SELF-FOAMING COMPOSITIONS

CROSS-REFERENCE TO RELATED APPLICATION(S)

This application claims priority to U.S. Provisional Patent Application No. 62/890,193, entitled "Skin Care Product Dispensers and Associated Concentrated Self-Foaming Compositions", filed Aug. 22, 2019, which is hereby incorporated by reference in its entirety.

FIELD OF THE INVENTION

Example embodiments of the present disclosure generally relate to skin care product dispensers and, more particularly to foam skin care product (e.g., soaps) dispensers and compositions used therein.

BACKGROUND

Foam skin care product dispensers (e.g., foam hand soap dispensers) are often provided in washrooms, in bathrooms, on work sites, hotels, and at other locations for providing a foamed skin care product for personal care. In some cases, the dispensers may be mounted to a wall or may be mounted under a counter, such as in conjunction with a faucet or separate and proximate thereto.

The dispensers include a reservoir of skin care product (e.g., soap) that is formed into foam in the dispenser or upon exiting the dispenser and provided to the user. Current commercial foam dispensers and techniques utilize pumps that draw in air for mixing with the skin care product. This requires a balance between the amount of the skin care product and the amount of air provided (e.g., certain ratios of air to skin care product are needed) to form the desired foamed skin care product for dispensing (which is also a balance between how much to provide from a volume perspective and maintaining a desired cleaning effect). To explain, a high concentration of skin care product would require a large volume of air to properly foam the skin care product, which would cause a significant size/engineering problem for the dispenser mechanics for the pump to achieve the needed volume of air. This limits how highly concentrated the skin care product can be in the dispenser. On the other hand, lower concentrations of the skin care product means that more skin care product will be needed for each dispense (to achieve the desired cleaning effect) thereby affecting how much is provided to the user and further resulting in either increasing the size of the reservoir or forcing more frequent reservoir replacements. Increased reservoir replacement is undesirable for a number of reasons including, for example, increased costs for shipping additional reservoirs, increased labor for monitoring and replacing the reservoirs, and an increased opportunity for an "out" scenario. Increased reservoir size, on the other hand, requires design changes in the dispenser and a larger dispenser footprint that may negatively affect the ability of the dispenser to be utilized by certain customers or in certain areas. Further, shipping larger reservoirs carries additional costs as well.

Accordingly, a need exists for alternative foam skin care product dispensers and corresponding compositions utilized therein.

BRIEF SUMMARY

Current commercial dispensers that utilize pumps for providing air to form the foam skin care product provide limited control and, further, it is difficult to accurately monitor the amount of foamable skin care product that is actually dispensed from the reservoir. As noted above, such mechanically generated foam dispensers (e.g., dispensers that utilize one or more pumps to provide air to cause formation of foam) have limitations when it comes to holding more highly concentrated skin care product in their reservoirs.

Chemically generated foam compositions have heretofore been used primarily in industrial applications, but have found use in some consumer products such as shaving creams and pressurized beauty products. Shaving type foams expand to large volumes and have smooth, luxurious handfeel due to long-chain soaps and skin lubricants; however, they provide little cleaning and lather when combining with water and scrubbing hands. Shaving cream's associated pressurized dispensers often clog due to residual product being trapped and drying in the dispenser outlet.

Some of the example dispenser systems described herein are configured to take advantage of the characteristics of the chemically generated foam using highly accurate valve based dispensing to dispense more concentrated and cost effective skin care product.

Some example embodiments of the present invention provide various foam skin care product dispensers and corresponding self-foaming compositions that can be utilized to provide foam skin care product (e.g., foam hand soap) to a user at an increased efficiency allowing increased concentration of the skin care product stored in the reservoir(s). For example, by concentrating the skin care product composition, the same amount of active cleaning agent within the skin care product can be dispensed from a smaller dose, still producing a desirable amount of useful foam skin care product, while increasing the number of doses per reservoir/refill and/or resulting in a smaller footprint.

Various embodiments of the present invention contemplate different dispenser set-ups along with one or more associated skin care products having an appropriate chemistry to achieve commercially acceptable foaming. For example, the dispenser may be configured to dispense a skin care product composition that is held under pressure (e.g. 50 psi), where the skin care product composition includes one or more propellants that are configured to expel the corresponding skin care product, which foams upon expansion.

Since the skin care product composition can be held in such high concentration, in some embodiments, the dispenser is configured to dispense a very small, but accurate, amount of skin care product composition from the reservoir(s). Some typical soap dispensers utilize mechanical pumps to dispense approximately 0.7 g per dose, which correlates to about 7 mL of useable foamed soap. In some embodiments of the present invention, however, the dispensers dispense a smaller weight dose (e.g., 0.4 g per dose or less, for example, 0.3 g per dose or less, for example, 0.25 g per dose or less, for example, 0.2 g per dose or less) but deliver a similar volume of useable foam soap (e.g. about 6 mL to about 10 mL per dose). Thus, some embodiments contemplate utilizing a metered valve or a solenoid valve to release an accurate amount of skin care product composition from the reservoir(s). Indeed, since the amount of skin care product being released is so small, accuracy is important because too much being released can cause an undesirable over-dispensing (e.g., overwhelming) or under-dispensing (e.g., insufficient) amount of foam skin care product being dispensed to a user. Further, a notable benefit of the example dispensers is that a dispense valve can be used instead of a pump since the skin care product composition is held under pressure and, thus, no pumping action is needed to move the skin care product composition to the dispense outlet.

In some embodiments, the reservoir for holding the skin care product composition may be held at a consistent (e.g., constant or near constant) pressure during the lifecycle of the reservoir to ensure a constant flow rate through a valve, which may aid in accuracy of dispensing. In some embodiments, a controller may be configured to vary the dose size of the dispense by enabling different amounts of time for the valve to remain open, such as to enable selection of an appropriate dose size (e.g., a small amount, a medium amount, a large amount, etc.), such as by a user (e.g., a maintenance person and/or end user) or a controller.

In some embodiments, one or more features/components may be added to the system to control dispensing along the flow path, such as through the one or more flow path structures (e.g., tubing, tunnels, rods, etc.), the dispense valve, and/or the dispensing outlet during or after a dispense occurs (e.g., to flush out the line (such as to prevent clogging due to, for example, bridging), to eliminate run-off that trickles out of the dispensing outlet, etc.). For example, in some embodiments, a flush valve (e.g., a second solenoid or metered valve) may be positioned proximate the dispensing outlet and can be shut off to prevent leaking out of the dispensing outlet. In another example embodiment, an air pump (e.g., air piston) may be provided to flush air through the flow path structures, the dispense valve, and/or the dispensing outlet to ensure a complete dispense and clear the lines. In yet another example embodiment, a flush propellant composition (e.g., from a dedicated flush reservoir) may be fed into the flow path structures, the dispense valve, and/or the dispensing outlet to ensure a complete dispense and clear the lines.

In some embodiments, various dispensers and systems contemplated herein may be configured for monitoring and reporting usage data or other data (e.g., maintenance, location, etc.), such as for use in conjunction with overall monitoring and reporting. For example, one or more sensors or measuring devices may be utilized to monitor data corresponding to the dispenser. Notably, in embodiments that utilize a metered or solenoid valve, the amount of skin care product composition dispensed can be measured/monitored. Such data can be stored and used, such as for monitoring when a refill is needed and/or in overall system usage reports. In some embodiments, the dispenser may include a wireless or wired communication interface that can enable transmission of the data to a remote device (e.g., a cloud server), for use therefrom. The cloud server may be configured to utilize the data for various dispenser system reports and/or tasks. As an example, the remote device and/or local dispenser may monitor the amount of skin care product composition remaining within a reservoir and cause a notification (e.g., a visual alert, an audible alert, a text, an email, a report, etc.) as an indication that a refill is needed, such as via a building maintenance system, a washroom monitoring system, or a remote and/or mobile device associated with a maintenance person.

Various systems and methods of dispensing foam skin care product contemplated herein provide many benefits, including for example providing a dispenser for delivering a highly concentrated skin care product composition which may be on the order of 2, 3, 4, 5, 6 and even as high as 12 times more concentrated (in terms of surfactant content) than current skin care product compositions—thereby providing for a longer life between necessary refill replacements and limiting maintenance personnel interaction with the dispenser. Such systems may also reduce overall cost, as the amount (but not the active level) of skin care product composition per dose dispensed is greatly reduced—significantly reducing the packaging costs from current foam skin care product dispensers that are available. Another benefit of possible systems contemplated herein is a reduction in the overall footprint of the dispenser as the size of the reservoir can be reduced due to the reduced amount of skin care product composition needed per dose, which may, for example, allow for small area under-counter installations due to plumbing configurations. Further, usage of dispense valves for dispensing, such as in various embodiments described herein, provides for more accurate, smaller doses per dispense and enables accurate measurements, such as may be useful for monitoring and reporting usage data.

In an example embodiment, a foam skin care product dispenser comprising a reservoir configured to hold, under pressure, a foamable skin care product composition is provided. The skin care composition includes a surfactant or a plurality of surfactants and at least one propellant. The dispenser further includes an activation sensor configured to detect a user. The dispenser includes a flow path leading to a dispensing outlet. The dispenser includes a dispense valve in fluid communication with the reservoir and the flow path. The dispense valve is movable between an open configuration and a closed configuration. The dispenser includes a controller configured to cause, in response to the activation sensor detecting the user, the dispense valve to move to the open configuration to release a portion of the skin care product composition under the pressure of the reservoir into the flow path downstream of the dispense valve. The portion of the skin care product composition released through the dispense valve is less than 0.4 grams, and wherein the portion of the skin care product released through the dispense valve comprises at least 7%, by weight, of the surfactant or the plurality of surfactants. The portion of the skin care product composition is configured to, after being released through the dispense valve, form a foamed skin care product that dispenses through the dispensing outlet.

In some embodiments, the portion of the skin care product composition released through the dispense valve is within a range of about 0.20 grams to about 0.30 grams.

In some embodiments, the portion of the skin care product composition released through the dispense valve is about 0.25 grams.

In some embodiments, the skin care product composition is held within the reservoir at a pressure ranging from about 50 psi-75 psi.

In some embodiments, the portion of the skin care product composition released through the dispense valve is consistent across a number of dispenses. In some embodiments, the number of dispenses comprises a range of 1500-2500 doses.

In some embodiments, a portion of the flow path leading from the dispense valve to the dispensing outlet defines a length of at least 100 mm.

In another example embodiment, a foam skin care product dispenser configured for mounting to a counter is provided. The foam skin care product dispenser comprises a dispensing spout positioned above the counter, wherein the dispensing spout comprises a dispensing outlet. The dispenser includes an undercounter receiving portion configured to removably receive a reservoir. The reservoir is configured to hold, under pressure, a foamable skin care product composition. The skin care composition includes at least one surfactant and at least one propellant. The dispenser includes an activation sensor configured to detect a user. The dispenser further includes a flow path leading to the dispensing outlet. The dispenser further includes a dispense valve in fluid communication with the reservoir and the flow path, wherein the dispense valve is movable between an open configuration and a closed configuration. The dispenser further includes a controller configured to cause, in response to the activation sensor detecting the user, the dispense valve to move to the open configuration to release a portion of the skin care product composition under the pressure of the reservoir into the flow path downstream of the dispense valve. The portion of the skin care product composition is configured to, after being released through the dispense valve, form a foamed skin care product that dispenses through the dispensing outlet.

In some embodiments, the dispense valve is one of a solenoid valve or a metered valve.

In some embodiments, a portion of the flow path leading from the dispense valve to the dispensing outlet defines a length of at least 100 mm.

In some embodiments, the portion of the skin care product composition released through the dispense valve is within a range of about 0.2 grams to about 0.3 grams.

In some embodiments, the undercounter receiving portion comprises a receiving valve configured to extend into an installed reservoir and cause the reservoir to be in a released state such that the skin care product composition enters a portion of the flow path leading to the dispense valve. In some embodiments, the reservoir defines a female outlet valve for receiving a portion of the receiving valve of the undercounter receiving portion.

In some embodiments, the reservoir includes an adapter configured to be removably mounted to the undercounter receiving portion. In some embodiments, the adapter defines a top wall that interacts with the undercounter receiving portion to ensure a desired installation position of the reservoir. In some embodiments, the adapter is configured to be removably mounted to the undercounter receiving portion via a threaded connection. In some embodiments, the adapter is configured to be removably mounted to the undercounter receiving portion via one or more snap features.

In some embodiments, the dispenser further comprises a check valve positioned along the flow path between the reservoir and the dispense valve, wherein the check valve is configured to enable liquid from the reservoir to pass through the check valve along a flow direction leading to the dispense valve and prevent liquid from passing back through the check valve in a direction opposite to the flow direction.

In some embodiments, the reservoir is configured to maintain a constant pressure between dispenses such that there is a constant flow rate through the dispense valve.

In some embodiments, the dispenser further comprises a communication interface configured to communicate with a remote device, wherein the controller is configured to monitor usage data corresponding to the skin care product dispenser and transmit the usage data via the communication interface to the remote device.

In some embodiments, the dispenser further comprises a flush valve positioned along the flow path downstream of the dispense valve and configured to close following a dispense occurrence to prevent leaking of residue out of the dispensing outlet.

In some embodiments, the dispenser further comprises an air pump configured to provide air to the flow path downstream of the dispense valve after or in conjunction with the occurrence of a dispense to aid in full evacuation of the released skin care product through the dispensing outlet.

In some embodiments, the dispenser further comprises a flush valve configured to provide fluid from a flush reservoir to the flow path downstream of the dispense valve after or in conjunction with the occurrence of a dispense to aid in full evacuation of the released skin care product through the dispensing outlet.

In yet another example embodiment, a skin care product dispenser is provided. The skin care product dispenser comprises a reservoir configured to hold a skin care product composition under pressure. The skin care product composition includes at least one surfactant and at least one propellent. The at least one surfactant comprises at least 7%, by weight, of the skin care product composition. The skin care product composition maintains a concentrated form under pressure and foams upon release from the pressure into a foamed skin care product. The skin care product dispenser includes an activation sensor configured to detect a user and a flow path in fluid communication with a dispensing outlet. The skin care product dispenser further includes a dispense valve positioned along the flow path between the reservoir and the dispensing outlet. The dispense valve is configured to open and close. The skin care product dispenser further includes a controller configured to cause, in response to the activation sensor detecting the user, the dispense valve to open such that the skin care product composition is released into the flow path toward the dispensing outlet. The controller is further configured to cause the dispense valve to close to cause a dose of the skin care product composition to have been released into the flow path toward the dispensing outlet. The dose of the skin care product composition released through the dispense valve is less than 0.4 grams.

In another example embodiment, a self-foaming skin care product composition is provided. The composition includes at least one anionic surfactant and at least one zwitterionic surfactant, wherein together, the at least one anionic surfactant and the at least one zwitterionic surfactant comprise a total surfactant. The composition further includes at least one hydrocarbon propellant and at least one $C_1$-$C_6$ alkyl ether propellant, wherein together, the at least one hydrocarbon propellant and the at least one $C_1$-$C_6$ alkyl ether propellant comprise a total propellant, wherein the total propellant is held at a pressure of between about 50 psi and about 75 psi until dispersed into atmospheric pressure.

In some embodiments, the anionic surfactant comprises an alkyl sarcosinate and the zwitterionic surfactant comprises an alkyl betaine.

In some embodiments, the anionic surfactant comprises sodium lauroyl sarcosinate and the zwitterionic surfactant comprises lauryl betaine.

In some embodiments, the hydrocarbon propellant comprises isobutane and the $C_1$-$C_6$ alkyl ether propellant comprises dimethyl ether.

In some embodiments, the composition comprises between about 7% and about 12%, by weight, of total surfactant.

In some embodiments, a dose is between about 0.20 grams and about 0.30 grams of self-foaming skin care product composition and the dose comprises between about 0.02 g and about 0.03 g of total surfactant per dose.

In some embodiments, the composition comprises between about 10% and about 15%, by weight, of total propellant.

In some embodiments, the ratio of the anionic surfactant to the zwitterionic surfactant is between about 2:1 and about 4:1.

In some embodiments, the ratio of the hydrocarbon propellant to the $C_1$-$C_6$ alkyl ether propellant is about 1:3.

In some embodiments, the composition comprises a self-foaming hand soap.

In some embodiments, upon dispersal into atmospheric pressure, the composition blooms to a foam skin care product which is at least twice the volume of the skin care product composition which was dispersed.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 11A:
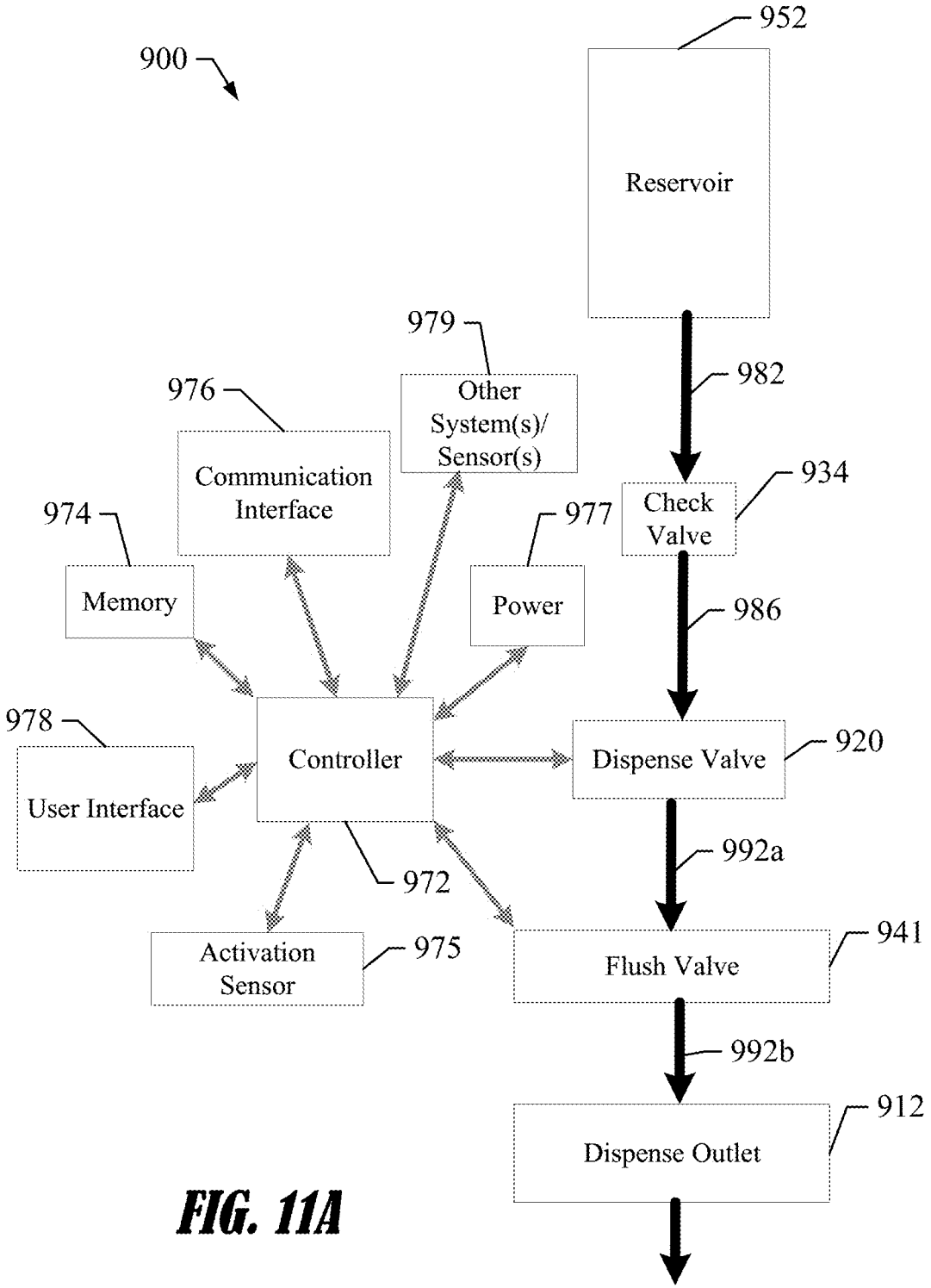
FIG. 11A shows a block diagram of another example foam skin care product dispenser including a flush valve positioned in a dispensing flow path, in accordance with some embodiments discussed herein.
Figure 11B:
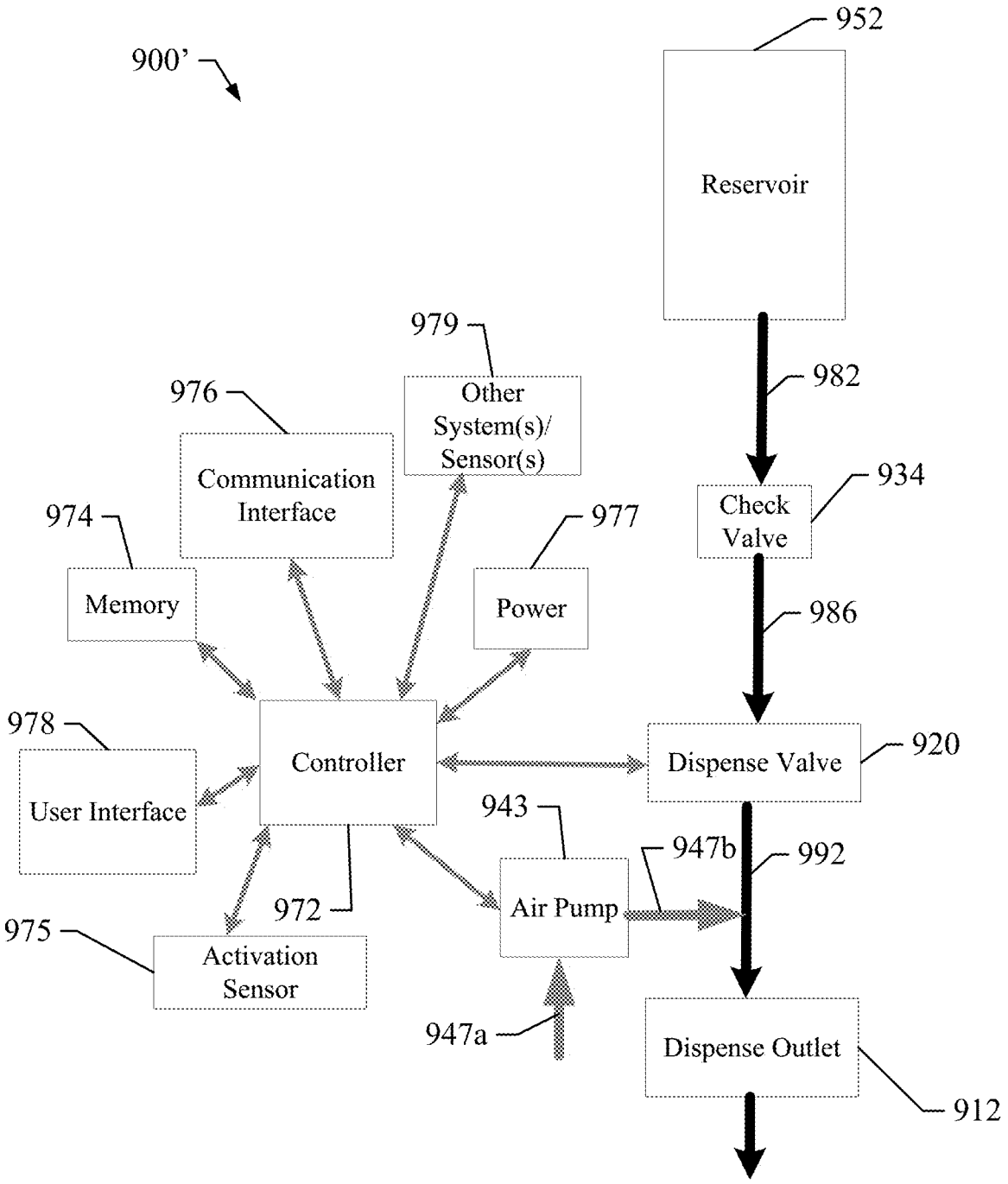
FIG. 11B shows a block diagram of another example foam skin care product dispenser including an air pump and corresponding mechanism configured to provide air to the dispensing flow path, in accordance with some embodiments discussed herein.
Figure 11C:
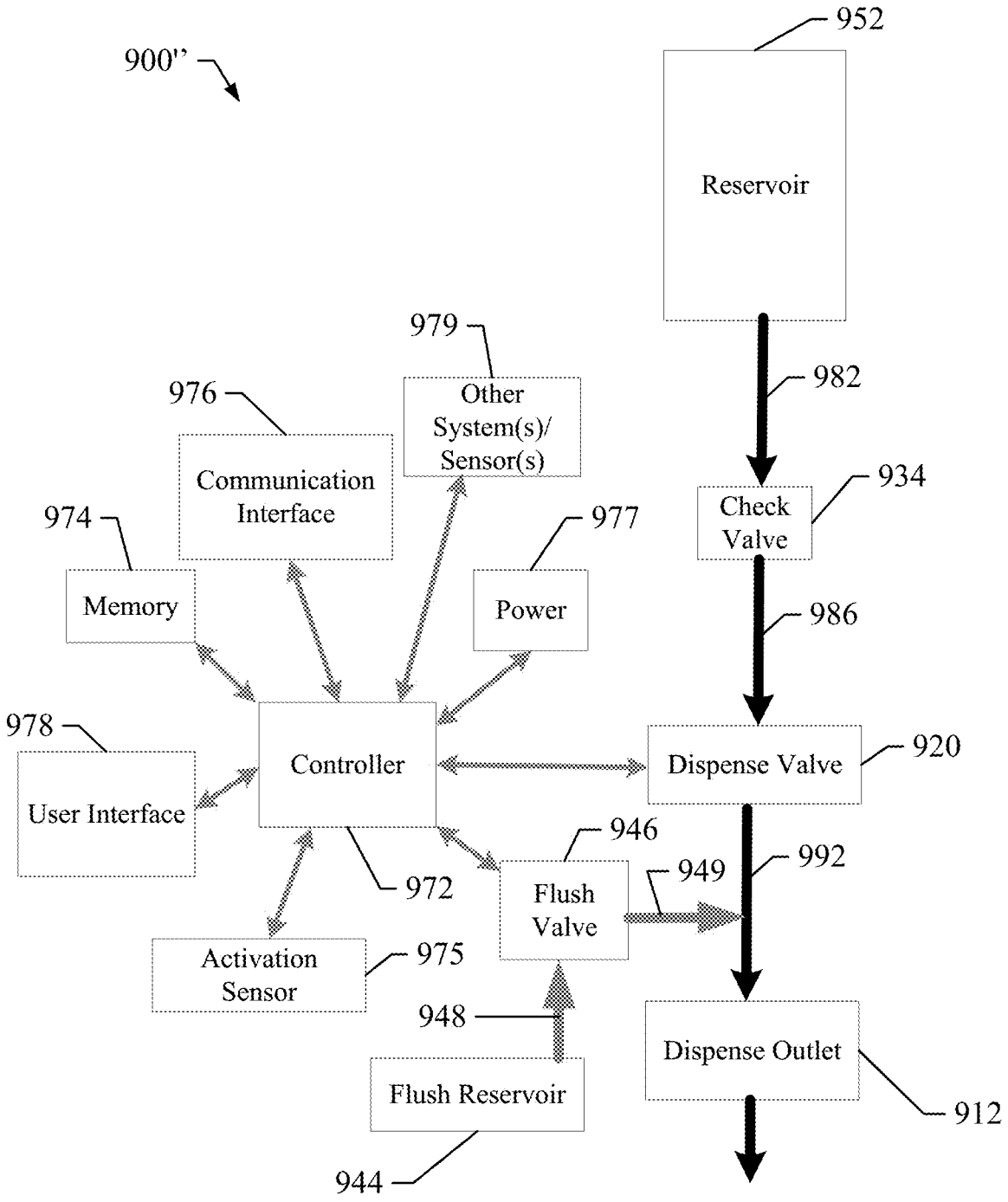
Figure 12:
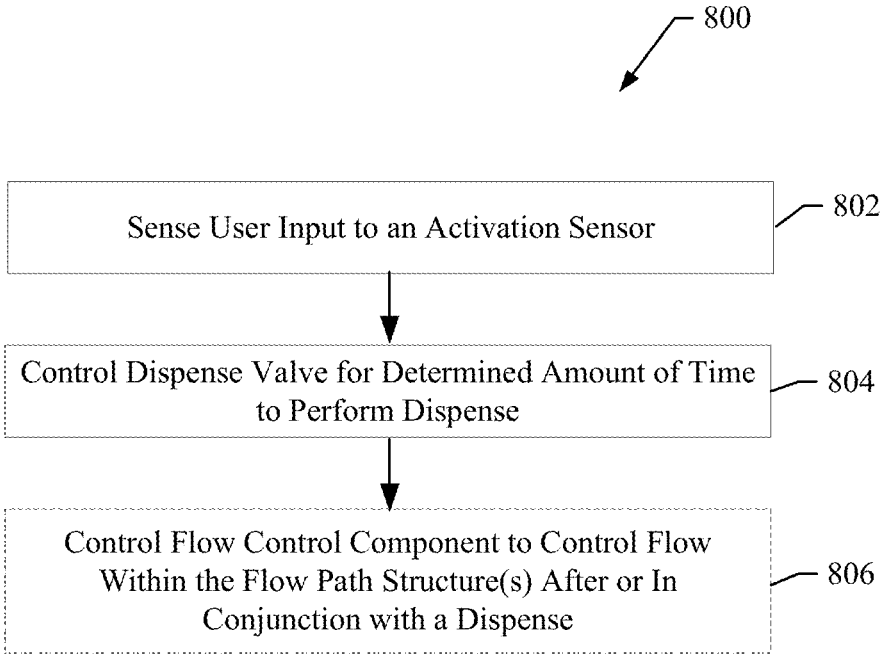

FIG. 11C shows a block diagram of another example foam skin care product dispenser including a flush reservoir and flush valve configured to provide a fluid to the dispensing flow path, in accordance with some embodiments discussed herein; and FIG. 12 illustrates a flowchart of an example method of operating example foam skin care product dispensers, in accordance with some embodiments discussed herein.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

Certain terms are used throughout the following description and claims to refer to particular features or components. As one skilled in the art will appreciate, different persons may refer to the same feature or component by different names.

In the following discussion and in the claims, the terms "including", "comprising", and "is" are used in an open-ended fashion, and thus should be interpreted to mean "including, but not limited to."

As used herein, the terms "skin care product" refers to a dispensed, foamed product which is useful for skin care purposes (e.g. cleansing and conditioning, moisturizing, etc.) and "skin care product composition" refers to an undispensed, unfoamed composition, that is contained within the dispenser reservoir and which, upon dispensing, is useful for skin care purposes (e.g. cleansing and conditioning, moisturizing, etc.). The terms "skin care concentrate," as used herein, refer to a formulation which is useful for skin care purposes but does not include a propellant. The term "soap" may refer to any type of cleaning or cleansing product for a user's skin, for example, including hand soap or body wash.

As used herein the term "propellant" refers to a material or a combination of materials that is combined with the skin care concentrate and/or added to the reservoir to maintain the system pressure and cause a foaming of the skin care concentrate upon dispensing. The skin care product and/or the skin care product composition may each contain one or more propellants. In an embodiment, the propellant(s) utilized herein maintains the pressure in the reservoir between about 30 psi and about 85 psi. In another embodiment, the propellant(s) utilized herein maintains the pressure in the reservoir between about 50 psi and about 75 psi. In other embodiments, the propellant(s) utilized herein maintains the pressure in the reservoir at or near 50 psi.

Example Foam Skin Care Product Dispensers

Example embodiments of the present invention provide foam skin care product dispensers that are configured to deliver a dose of foamed skin care product to an end user. Such example embodiments may utilize any type of dispenser housing/configuration with the components and features necessary to provide the dose of foamed skin care product to the end user. For example, FIGS. 7, 8, and 11A-C provide example block diagrams of example foam skin care product dispensers and their corresponding components/ features. Notably, such example components/features (including others described herein) may be utilized with any type of dispenser housing/configuration, such as a wall mounted dispenser, a counter mounted dispenser, a stand-alone dispenser, an under-cabinet mounted dispenser, among many others.

Figure 1:
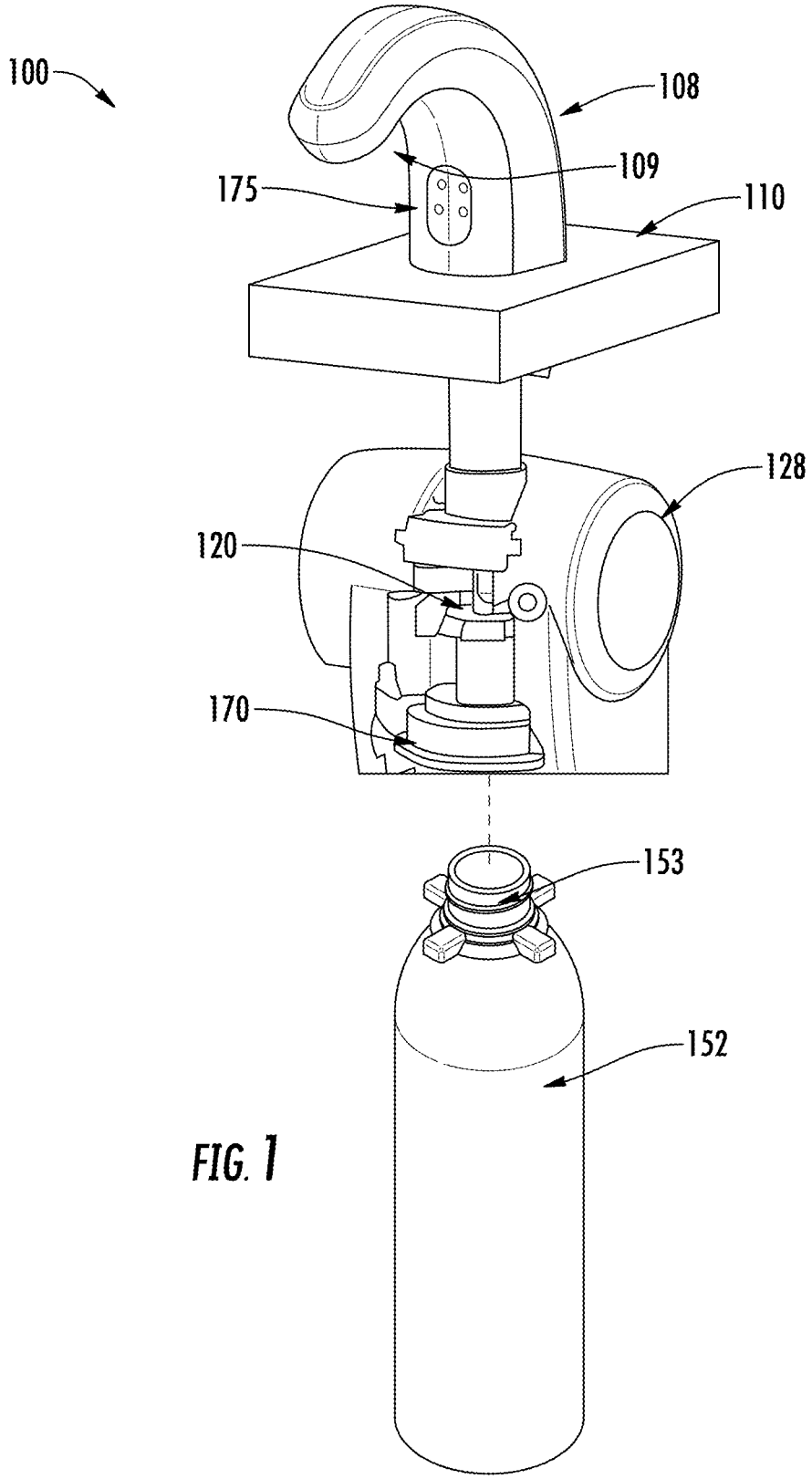
FIG. 1 illustrates a partially exploded view of an example counter mounted foam skin care product dispenser, in accordance with some example embodiments described herein.

FIG. 1 illustrates an example counter mounted foam skin care product dispenser 100, such as may be utilized in accordance with various embodiments herein. The dispenser 100 may be mounted, such as using fasteners, adhesive, or other attachment means to a counter 110 (or other structure). A spout portion 108 may extend above the counter 110 and, in some cases, over a sink or other washroom fixture. The spout portion 108 may include a dispense outlet 109, an activation sensor 175, and an internal passage for receiving a dispensing flow path structure 192 (e.g., tubing, tunnels, rods, or other structures that allow flow therethrough—such as known to one of ordinary skill in the art).

The counter mounted dispenser 100 may also include a housing 128 that holds one or more components of the dispenser 100, such as one or more valves, a controller, a communication interface, a memory, one or more power sources, among other things. The housing 128 may be configured to enable attachment to the counter 110 and/or may be configured to enable attachment of one or more reservoirs 152. In this regard, the housing 128 may act as a reservoir receiving portion. For example, a reservoir receiving portion 170 is configured with one or more attachment features for removably attaching a reservoir 152 to the housing 128 (e.g., the reservoir 152 includes an adapter 153 that may removably attach to the reservoir receiving portion 170 of the housing 128). Notably, the reservoir 152 is shown detached from the reservoir receiving portion in an exploded view in FIG. 1, but attached to the reservoir receiving portion 170 in FIG. 3. In some embodiments, the reservoir receiving portion 170 may be attached to the housing 128 and may facilitate removable attachment of a reservoir 152, such as for enabling a maintenance person to replace an empty reservoir 152 with a replacement reservoir.

The reservoir 152 may be a container that is configured to hold an amount of skin care product composition and, in some embodiments, a propellant composition. The contents of the reservoir 152 are generally held under pressure. In some embodiments, the reservoir 152 may hold a skin care product composition that includes various ingredients designed for use with the foam skin care product dispenser. For example, the skin care product composition may include one or more surfactants and one or more propellants.

In some embodiments, the one or more propellants may be configured with a boiling point above the temperature/pressure at which it is held within the reservoir 152 such that it remains in liquid form while held therein. In other embodiments, the propellant may be in the gaseous phase or a liquid/gas phase in the reservoir 152. In an embodiment, one or more of the propellant(s) may comprise pressurized gas in equilibrium with its liquid in the container, i.e., it is at its saturated vapor pressure. As some gas escapes to expel the material from the container, more of the propellant liquid vaporizes thereby maintaining a consistent pressure. The propellant can be a material which does not interact with or dissolve in the skin care concentrate or it may be a material that is dissolved in, partially dissolved in, or suspended in the skin care concentrate. In an embodiment, the propellant component may comprise two propellants, one of which may not be soluble with the skin care concentrate. This first propellant may exist in a liquid/vapor phase within the dispenser and may float above the surface of the liquid skin care concentrate. A second propellant may be utilized which at least partially dissolves in the skin care concentrate. In an embodiment, the propellant may comprise non-volatile compressed gases, such as nitrogen ($N_2$) or carbon dioxide ($CO_2$), for example. In an embodiment, the propellant forms gas upon dispersal, which creates a foam. Further, in some embodiments, the reservoir 152 may include an expanding solvent dissolved in the skin care product composition. The expanding solvent dissolved within the skin care product composition in the reservoir 152 may expand as the skin care product composition and the propellant composition are released from the reservoir 152, the dissolved solvent creating the gas which foams the released skin care product. As noted herein, the propellant maintaining a consistent pressure within the reservoir 152 may enable a constant flow rate through the dispense valve 120.

The materials of construction for the dispenser and reservoir can be selected appropriately by the skilled artisan based upon the particular composition of the skin care product. For example, in some embodiments, the reservoir may be formed from tin-plated steel, aluminum, glass, plastic, or any other material known in the art. The skilled artisan will understand that skin care product compositions react differently in a metal or glass reservoir (hydrophilic type) than they do in a plastic reservoir (hydrophobic type) and may select the material(s) for construction of the dispenser and reservoir accordingly. In an embodiment, the reservoir may be coated on an interior surface with various coating materials or surface modifiers.

In some embodiments, the reservoir 152 may be specifically sized for a desired dispenser and/or space. For example, it may be desirable for the reservoir to have a relatively smaller footprint, which may enable installation and positioning in tighter spaces (e.g., under a counter, within a dispenser housing, etc.). However, because of the dispenser components and the skin care product composition, the smaller reservoir can still accomplish a desirably large number of doses per reservoir. For example, a conventional counter mounted foam skin care product dispenser may be configured to utilize a reservoir with a size ranging from holding 900 mL-1800 mL and achieve a number of doses ranging from ~1250 doses-2500 doses (depending on the reservoir size and amount of each dose). In contrast, some embodiments provide a reservoir that may hold around ~500 mL-750 mL (e.g., 650 mL), and still achieve a number of doses ranging from ~1500 doses ~2500 doses (such as depending on the utilized dose size and skin care product composition—as described herein). Thus, the same number of doses can be achieved with a smaller reservoir while the effectiveness of the cleaning of the provided dose of foamed skin care product is maintained (or even improved). Notably, the above example ranges are not meant to be limiting, as other ranges are contemplated for reservoir size and anticipated number of doses per reservoir.

As detailed herein, the reservoir 152 is held under pressure. Depending on the skin care product composition within the reservoir, the degree of pressure of the reservoir may vary, such as within a range of 50 psi-75 psi (e.g., at ~50 psi). Notably, in some embodiments, the skin care product composition may be chosen to achieve a relatively lower degree of pressure than typical aerosol containers in order to help safely and effectively interact with the components of the dispenser. Said differently, in order to enable a long life of the dispenser and still maintain the desired accuracy of the dosing (such as in consideration of the various components used (e.g., the tubing, the valve, etc.) the reservoir may be designed with a lower degree of pressure (e.g., within 50 psi-75 psi). For example, various ingredients and their relative amounts within the skin care product composition may be designed with the dispenser in mind. For example, a portion of the flow path leading to the dispense valve may maintain the skin care product composition at the same pressure as the reservoir (e.g., prior to release through the dispense valve) and, thus, the pressure within the reservoir may need to account for configuration of use of the pressure in such flow path structures. Further, providing the skin care product composition at a (relatively) lower pressure means that the dispense valve may be open longer to achieve a desired dosage size—which leads to more accurate dispensing (e.g., the higher the pressure, the faster the flow through the dispense valve). As another example, a counter mounted dispenser may have a flow path structure 192 leading from the dispense valve 120 to the dispensing outlet (e.g., out of the spout 109) with a length that may need to be accounted for (e.g., a length of at least 100 mm, although a contemplated range from 200 mm to 400 mm is also contemplated, with another possible range of 250 mm to 350 mm). Due to the extended length of travel, certain adjustments may need to be made to the skin care product composition to enable the desired repeated, accurate dosing scheme for the dispenser.

Figure 2:
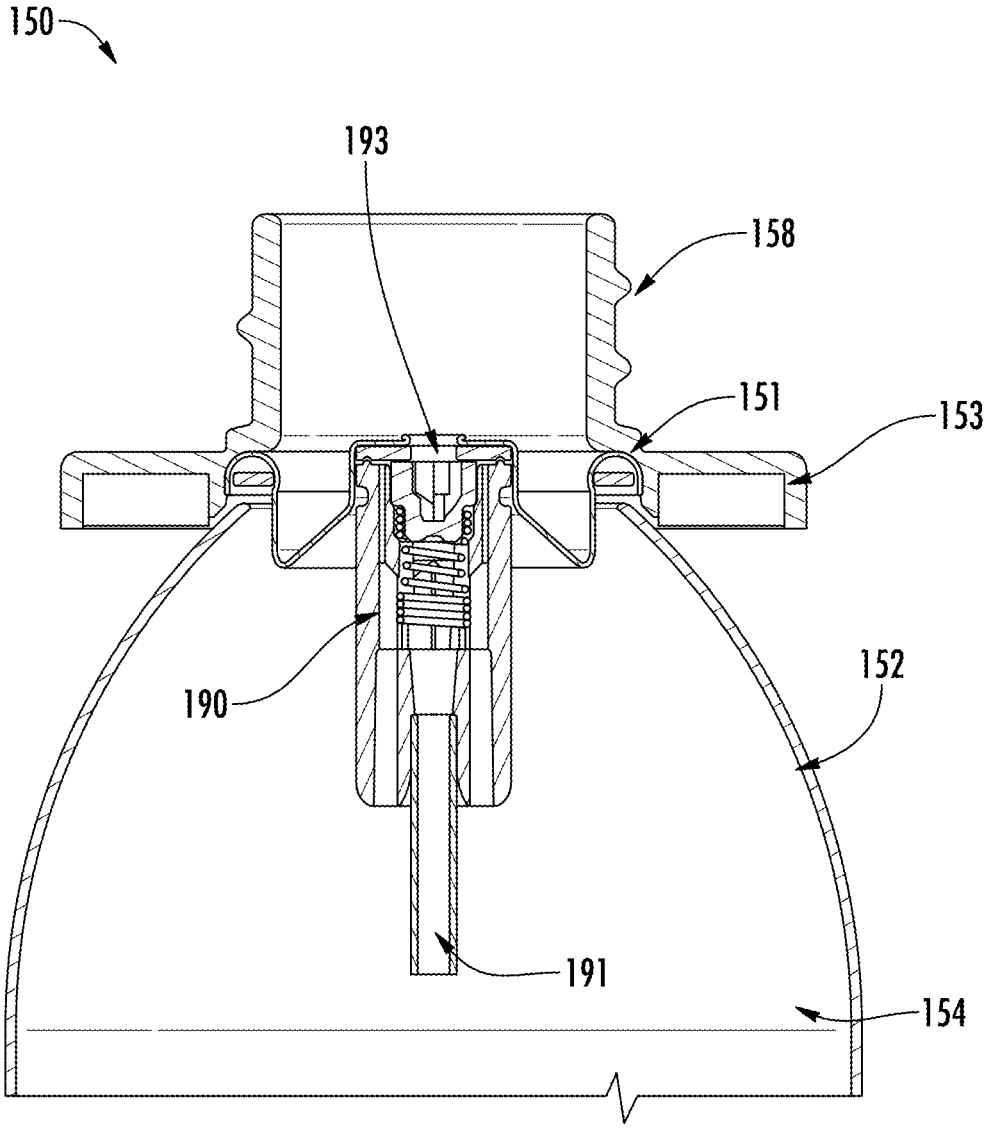
FIG. 2 illustrates a portion of the reservoir used in conjunction with the example counter mounted foam skin care product dispenser shown in FIG. 1, wherein the reservoir includes an attached adapter for removably mounting the reservoir to the counter mounted foam skin care product dispenser, in accordance with some example embodiments described herein.

With reference to FIG. 2, a portion of an example assembly 150 of the reservoir 152 and attached adapter 153 is shown. The adapter 153 is attached (e.g., snap fit) onto the top rim 151 of the reservoir 152. A release valve 190 for the reservoir 152 may be installed within the top rim 151 and enable release of the contents of the reservoir 152 held therein 154. The release valve 190 may include an inlet 191 fluidly connected to the interior 154 of the reservoir 152 and an outlet 193. The release valve 190 may be biased to the closed configuration. However, once installed within the dispenser (shown in FIG. 3), then the release valve 190 may open to release the skin care product composition through the outlet 193 of the release valve 190. In the illustrated embodiment, a female-type release valve 190 is utilized, and provides a notable benefit of not needing a protective cover during shipping when the adapter 153 is attached. In this regard, there is less risk of inadvertent opening of the release valve 190 than with a male-type release valve which would stick upwardly and be prone to inadvertent interaction with various things during shipping—perhaps causing undesired opening of the release valve 190. Notably, however, in some embodiments, a dust cap or other additional protective feature may be utilized with the female-type or a male-type release valve.

Figure 3:
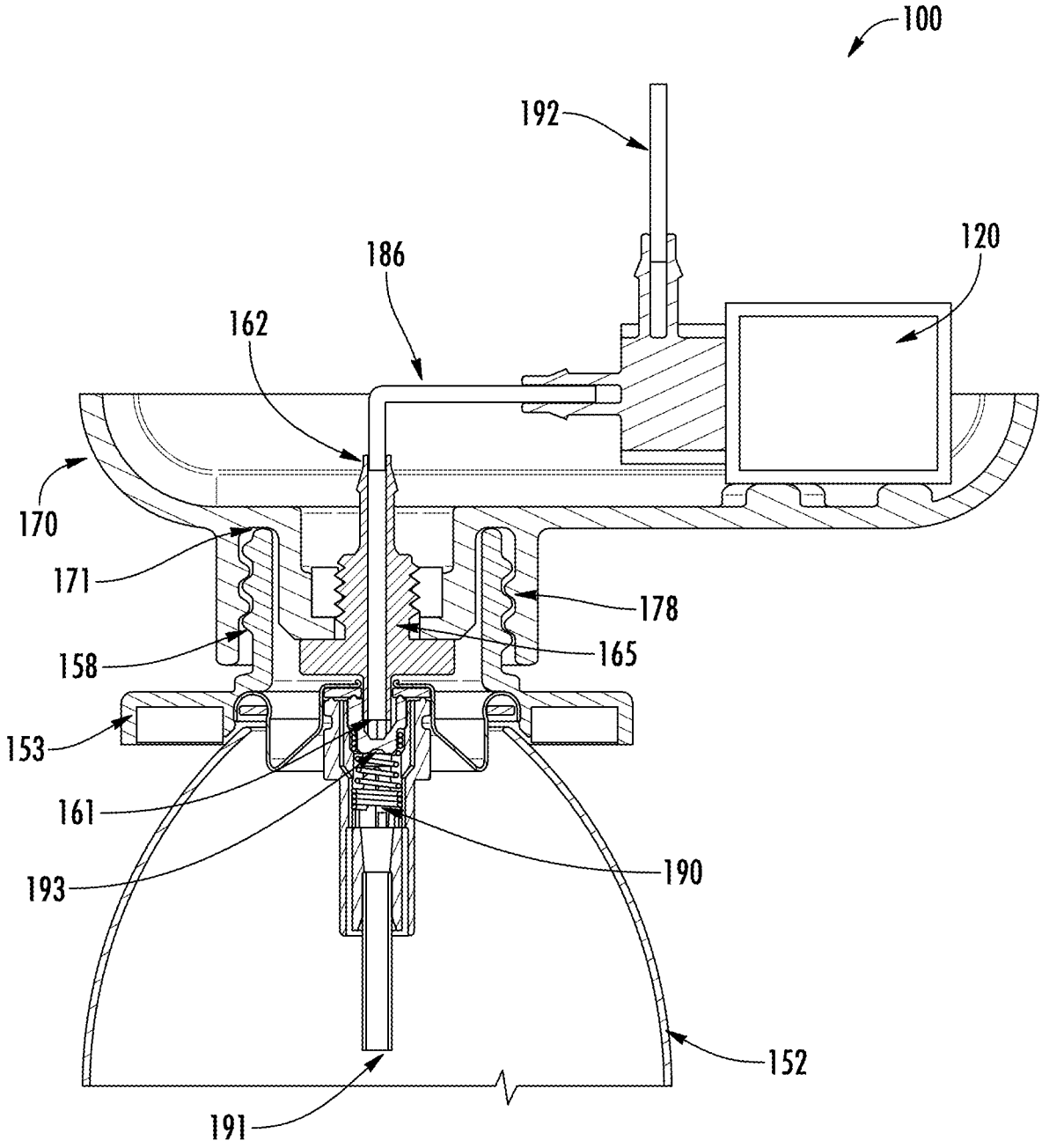
FIG. 3 illustrates a schematic of an example counter mounted dispenser with a reservoir attached thereto, in accordance with some example embodiments described herein.

The illustrated adapter 153 includes a threaded connection feature 158 that can be utilized with corresponding threads 178 on a reservoir receiving portion 170 of the housing of the dispenser 100 (shown attached in FIG. 3). In this regard, the adapter 153 may be configured to enable removable mounting the reservoir 152 to dispenser 100.

FIG. 3 illustrates an example counter mounted dispenser 100 with a reservoir 152/adapter 153 attached thereto. Notably, the adapter 153 and the reservoir receiving portion 170 may be configured such that rotation of the adapter 153 into the reservoir receiving portion 170 is limited via a top wall 171. The top wall 171 may define a relative height that causes the adapter 153 and attached reservoir 152 to be appropriately positioned relative to a connector 165. In this manner, the connector 165 may interact with the release valve 190 of the reservoir 152 to open the release valve 190 to enable flow of the contents of the reservoir 152 into the flow path of the dispenser 100. For example, the connector 165 may include an inlet 161 that projects toward the outlet 193 of the release valve. During installation, positioning of the adapter 153 into the threads 178 of the reservoir receiving portion 170 causes the inlet 161 of the connector 165 to push down on and transition the release valve 190 into an open configuration to release the skin care product composition into the connector 165, through the outlet 162 of the connector 165 and into the flow path structure 186 up to the dispense valve 120 (which is in the closed configuration when dispensing is not actuated). In such a configuration, the dispenser 100 is now primed and ready for operation. In some embodiments, a corresponding indication can be provided, via a controller/communication interface/user interface, such as described herein. Notably, the illustrated embodiment in FIG. 3 illustrates an example flow path of the dispenser leading from the inlet 161 of the connector 165 to a dispensing outlet, which is past (or at the end of) the flow path structure 192. While it appears that flow is halted between flow path structure 186 and flow path structure 192, this is merely meant to illustrate the presence of an example dispense valve 120 along the flow path (where the dispense valve 120 may be in an open configuration (allowing flow therepast) or a closed configuration (preventing flow therepast)).

Accordingly, the dispenser 100 may include a dispense valve 120 (such as a solenoid valve or metered valve) that can be opened or closed. For example, in response to receiving user input from the activation sensor 175, a controller (e.g., controller 372 shown in and described with respect to FIG. 7) may be configured to open the dispense valve 120 to enable skin care product composition to flow into the dispense flow path structure 192 (e.g., tubing) toward the dispense outlet 109. According to one embodiment, when a skin care product composition, including a propellant, are contained in the reservoir and the composition exits the dispense valve 120, the pressure drop may cause at least one propellant to vaporize, thereby causing it to turn into a gas. Vaporization of the propellant composition causes mixing of the gas with a remaining portion of the released skin care product composition in the dispense flow path structure 192 to form a foamed skin care product that is dispensed to a user through the dispense outlet 109.

Figure 7:
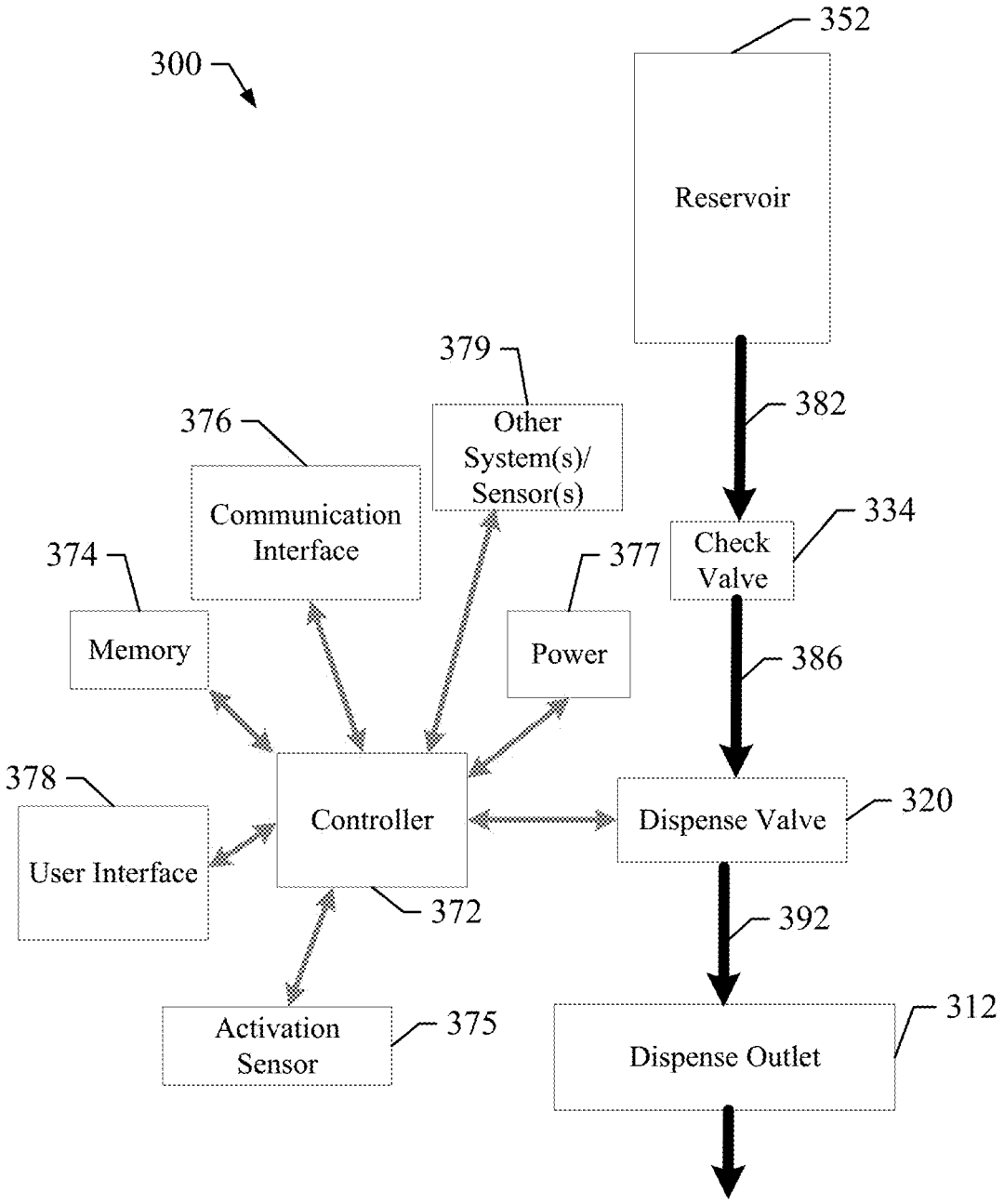
FIG. 7 shows a block diagram of an example foam skin care product dispenser including a single reservoir, in accordance with some embodiments discussed herein.

In some embodiments, the dispenser 100 may include one or more check valves (such as check valve 334 shown in and described with respect to FIG. 7). The check valve may be configured to enable flow of the skin care product composition therethrough without reverse flow back therethrough. In some embodiments, the check valve may be positioned downstream of the connector 165 but prior to the dispense valve. In such an example, the check valve may prevent skin care product composition left within the flow path upstream of the check valve from leaking out of the connector 165 upon removal of the reservoir 152 (such as for replacing the reservoir).

Figure 4:
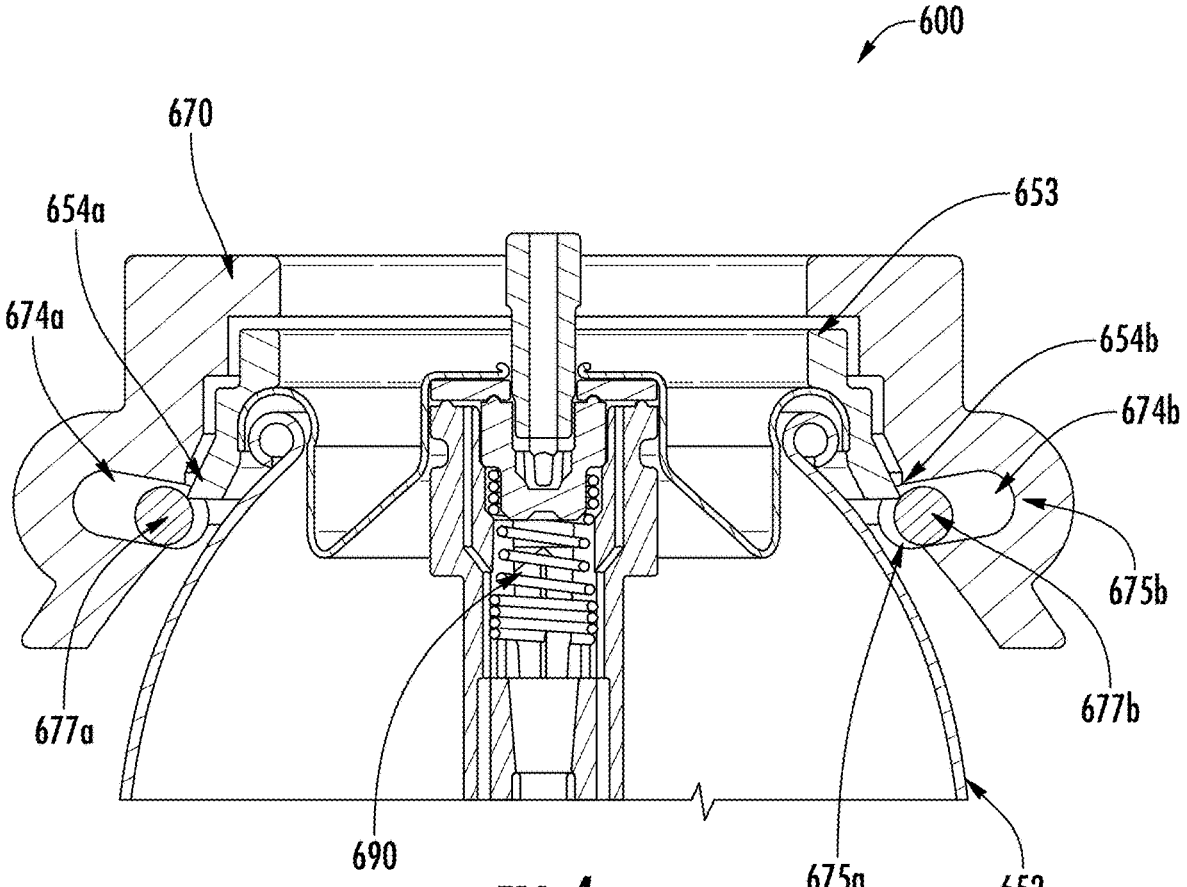
FIG. 4 illustrates a schematic of a portion of a reservoir attached to an example reservoir receiving portion of an example foam skin care product dispenser, in accordance with some example embodiments described herein.

In some embodiments, other forms of connection between the reservoir 152 and/or adapter 153 may be contemplated. For example, FIG. 4 illustrates an example portion of a dispenser 600 where the reservoir 652 includes an attached adapter 653 with at least two protrusions 654*a*, 654*b*. Upon upward insertion of the adapter 653 and reservoir 652 into the reservoir receiving portion 670, balls 677*a*, 677*b* move within corresponding slots 674*a*, 674*b* (e.g., due to the taper of the protrusions 654*a*, 654*b*) away from the protrusions 654*a*, 654*b* (e.g., ball 677*b* moves toward an end 675*b* of the slot 674*b*). Since the balls 677*a*, 677*b* are biased toward a front of the slot (e.g., the front 675*a* of the slot 674*b*), the balls will return to the biased position and the protrusions 654*a*, 654*b* will sit on top of the corresponding balls 677*a*, 677*b*—thereby keeping the reservoir 652 and adapter 653 attached to the reservoir receiving portion 670. To remove the reservoir 652 and adapter 653, a mechanical release feature may be used to pull the balls 677*a*, 677*b* away from their position to allow the protrusions 654*a*, 654*b* to move past the balls 677*a*, 677*b*—enabling removal of the reservoir 652 and adapter 653.

Figure 5A:
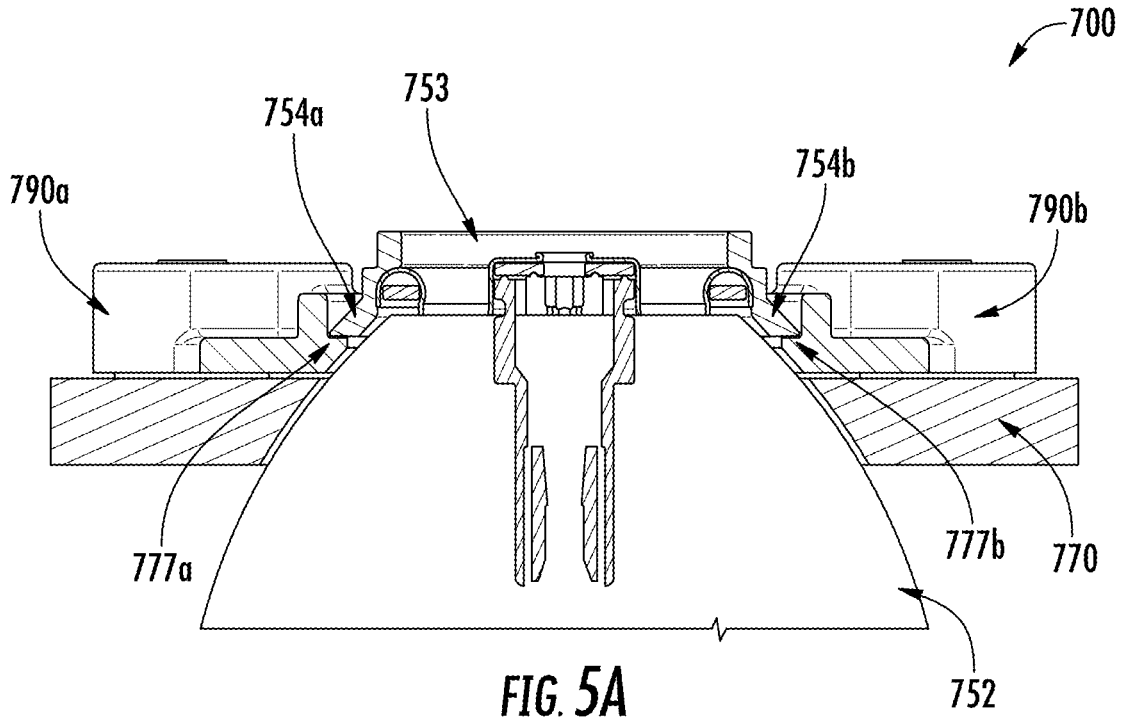
FIG. 5A illustrates a schematic of a portion of a reservoir attached to another example reservoir receiving portion of another example foam skin care product dispenser, in accordance with some example embodiments described herein.
Figure 5B:
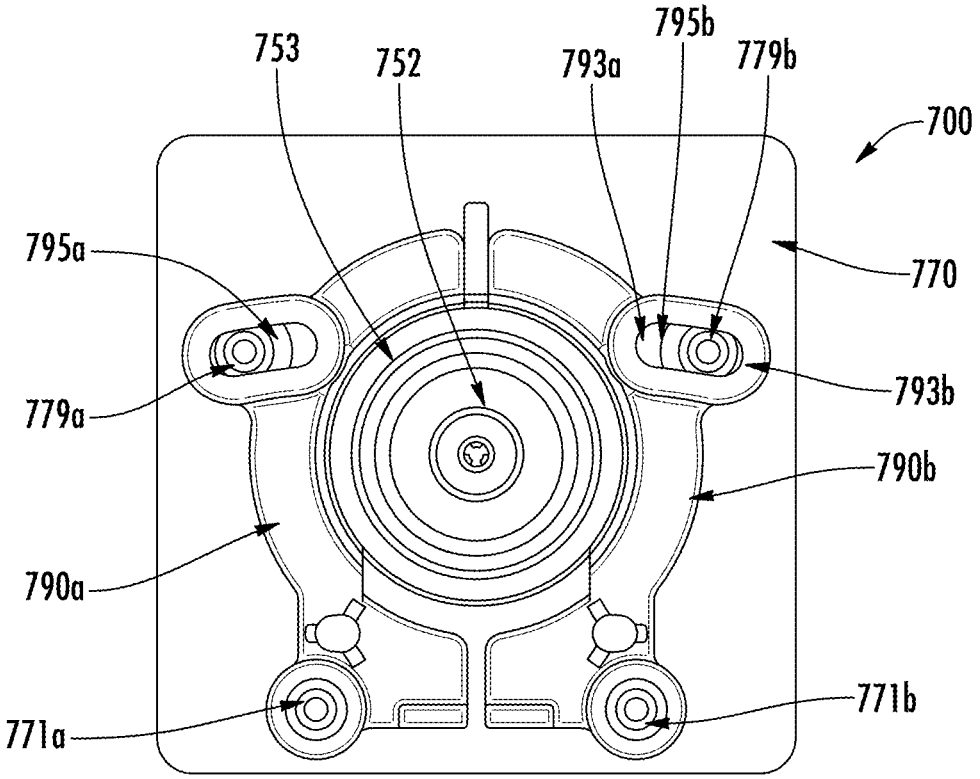
FIG. 5B illustrates a top view of the portion of the reservoir and the reservoir receiving portion shown in FIG. 5A, in accordance with some example embodiments described herein.

FIGS. 5A-5B illustrate another example connection scheme for the reservoir and adapter. FIG. 5A illustrates an example portion of a dispenser 700 where the reservoir 752 includes an attached adapter 753 with at least two protrusions 754*a*, 754*b*. Upon upward insertion of the adapter 753 and reservoir 752 into the reservoir receiving portion 770, arms 790*a*, 790*b* move (e.g., due to the taper of the protrusions 754*a*, 754*b*) away from the protrusions 754*a*, 754*b*. For example, with reference to FIG. 5B, a first arm 790*a* may be configured to pivot about a first pivot point 771*a*. Further, a first slot 795*a* may define a direction of the pivot through interaction with a first peg protrusion 779*a* from the reservoir receiving portion 770. Likewise, a second arm 790*b* may pivot about a second pivot portion 771*b*. Accordingly, a second slot 795*a* may move with respect to a second peg protrusion 779*b* (e.g., the second peg protrusion 779*b* may move from being proximate (and/or engaged with) an end 793*b* of the second slot 795*b* to a front 793*a* of the second slot 795*b*). Since the arms 790*a*, 790*b* are biased to return to the original position, the arms 790*a*, 790*b* will return to the original position and the protrusions 754*a*, 754*b* will sit on top of corresponding shoulders 777*a*, 777*b* of the arms 790*a*, 790*b*, respectively. Thus, the reservoir 752 and adapter 753 become attached to the reservoir receiving portion 770. To remove the reservoir 752 and adapter 753, a mechanical release feature may be used to pull the arms 790*a*, 790*b* away from their position to allow the protrusions 754*a*, 754*b* to move past the shoulders 777*a*, 777*b*—enabling removal of the reservoir 752 and adapter 753.

The above example embodiments illustrate just some example connections of the reservoir and/or adapter to the reservoir receiving portion. In some embodiments, other connections are contemplated.

Figure 6:
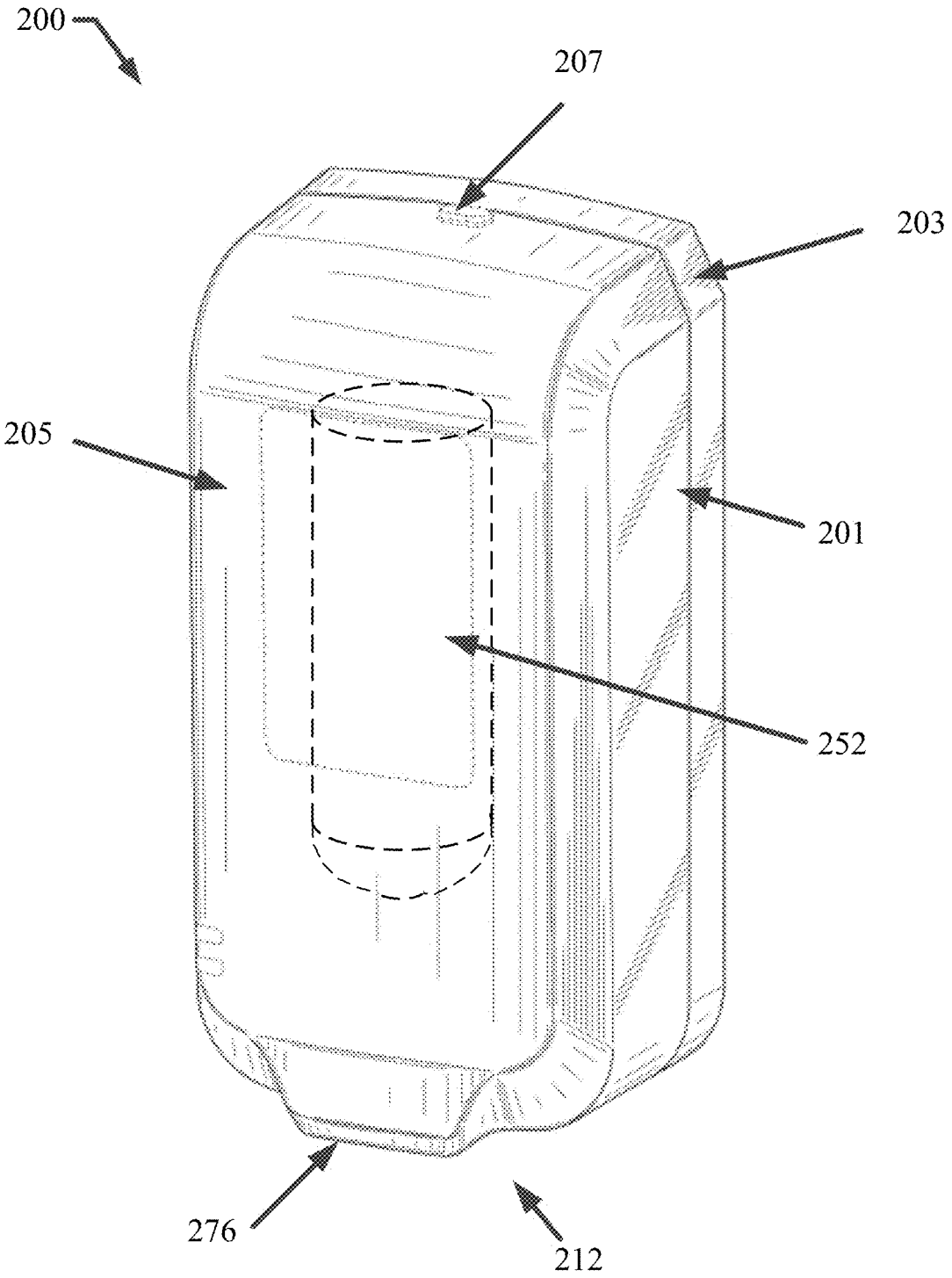
FIG. 6 illustrates an example wall mounted foam skin care product dispenser, where the reservoir for the dispenser is shown in dotted line for explanatory purposes, in accordance with some example embodiments described herein.

FIG. 6 illustrates another example foam skin care product dispenser 200, such as may be utilized in accordance with various embodiments herein. Notably, the illustrated skin care product dispenser 200 is configured to be wall-mounted. In this regard, the illustrated dispenser 200 includes a housing 201 formed of a back portion 203 and cover 205. The back portion 203 may include one or more mounting features that can be utilized to mount the dispenser 200 to a wall (or other structure). A user, such as a maintainer or maintenance person, may open the cover 205, such as by inserting a key or pressing a button (e.g., with respect to a latch 207). In general, the dispenser housing encloses the reservoir 252 (shown in dotted line to illustrate a possible location inside the housing 201) such that only approved individuals may access the interior of the dispenser (including the reservoir). For example, the cover 205 may form a hinged door or removable panel that may be secured to prevent unauthorized access to the interior of the dispenser. The cover 205 may be secured in a closed position with a key or other locking mechanism.

The dispenser 200 also generally includes an activation mechanism. For example, the dispenser 200 may comprise a button, lever, motion sensor, and/or the like that a user may press or otherwise interact with to activate the dispenser. For example, the user (e.g., consumer) may wave his or her hand in the vicinity of a motion detector (e.g., at 276) or may press a lever on the dispenser to cause the dispenser to provide the dispense of the foam skin care product to the user. As noted herein, various components of the dispenser 200 may be included within the housing, such that during a dispense cycle, a controller may activate a dispense valve to cause a release of the skin care product composition from under the pressure of the reservoir. Such as described herein, the released skin care product composition changes to a foamed skin care product, which is dispensed out of the dispense outlet 212 to the user.

Figure 8:
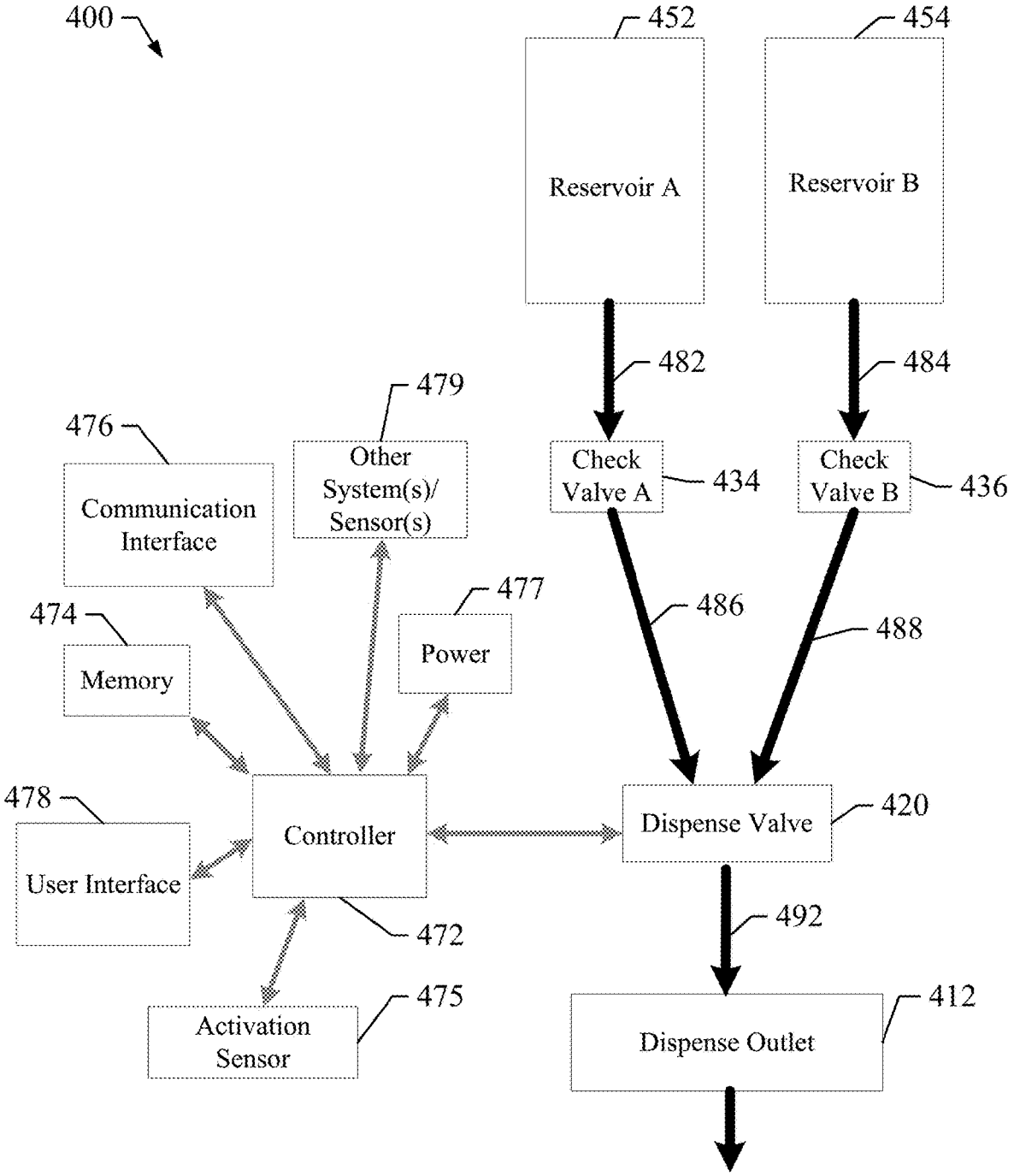
FIG. 8 shows a block diagram of an example foam skin care product dispenser including two reservoirs, in accordance with some embodiments discussed herein.

Although shown as utilizing a single reservoir in FIGS. 1, 3, and 6, as described herein, some embodiments contemplate utilizing multiple reservoirs for each dispenser, such as the dual reservoir system described with respect to FIG. 8. In such embodiments, the housing 128 may be configured to removably receive the multiple reservoirs, such as individually or together.

Example Functionality

As detailed herein, some embodiments of the foam skin care product dispensers and corresponding compositions cooperate to provide a foam skin care product to a user at an increased efficiency—making it possible for concentrated skin care products to be dispensed from the reservoir(s). A small volume of concentrated skin care product composition can be dispensed per dose, while still providing a desirable amount of useful skin care product due to the foaming effect. The self-generating foam cleansing compositions act similar to currently marketed shaving creams where a pea sized amount can result in a handful of shaving foam. This increases the number of doses per reservoir/refill and/or allows a reduction in the overall size of the reservoir/refill. Such embodiments may also decrease how often a refill replacement is needed, thereby reducing how often a maintenance person needs to interact with the dispenser.

In some example embodiments, the dispenser may be configured to dispense foam skin care product from one or more reservoirs that contain skin care product composition (including a propellant) that is held under pressure. The propellant holds the reservoir at a consistent (e.g., constant or near constant) pressure during its lifecycle to ensure a constant flow rate through a dispense valve, which may aid in accuracy of dispensing.

In some embodiments, the dispense valve may be a metered valve or a solenoid valve to release an accurate and small amount of skin care product composition from the reservoir(s). Since the skin care product composition is held in such high concentration, the dispenser may be configured to dispense a very small, but accurate, amount of skin care product composition from the reservoir(s). In this regard, while some typical soap dispensers utilize mechanical pumps to dispense approximately 0.7 g to 1 g per dose (providing about 10 mL of usable foam soap), some embodiments of the present invention contemplate accurately dispensing smaller dosages of the skin care product composition (e.g. 0.4 g per dose or less, 0.3 g per dose or less, 0.25 g per dose or less, or even 0.2 g per dose or less (e.g., 0.06 g)), which may be accomplished by utilizing a metered valve or a solenoid valve. In an embodiment, though the dispensed composition comprises a lesser weight, the inventive system may deliver a greater volume of useable foam soap (e.g. about 8 mL to about 12 mL per dose, or about 10 mL per dose) due to the blooming foam effect.

Notably, since the amount of skin care product composition being released is so small, accuracy is important because variation in the amount being released can cause an undesirable over-dispensing (e.g., overwhelming) or under-dispensing (e.g., insufficient) amount of foam skin care product being dispensed to a user. Moreover, a notable benefit of the example dispensers is that a dispense valve can be used instead of a pump since the skin care product composition is held under pressure and, thus, no pumping action is needed to move the skin care product composition to the dispense outlet.

In some embodiments, various dispensers and systems contemplated herein may be configured for monitoring and reporting usage data or other data (e.g., maintenance, location, etc.), such as for use in conjunction with overall monitoring and reporting. For example, a controller (such as various controllers described herein), may be configured to monitor such data, for example through one or more sensors or measuring devices. Such data may be stored (e.g., within a memory) and/or transmitted (e.g., using a wireless or wired communication interface) to a remote device. Such data can be stored and used, such as for monitoring when a refill is needed and/or in overall system usage reports (e.g., creating various dispenser system reports and/or completed various dispenser system tasks).

For example, in embodiments that utilize a metered or solenoid valve, the amount of skin care product composition dispensed can be measured/monitored by the controller (e.g., by counting the number of dispenses and knowing the accurate amount of dispensed compositions per dispense). One benefit of some embodiments that utilize a metered or solenoid valve is that there is a smaller range of accuracy control (e.g., ±5%) for the amount of product measured versus actual amount of product dispensed than in typical air injection-based systems (in which the percentage is closer to ±15%). System benefits associated with the improved accuracy include greater control over the dose amount as well as better accuracy associated with determining when reservoir replacement is needed. Air injection systems with their ±15% error rate have been known to lead to a larger than desirable amount of product remaining in the bottle when those systems indicate the need for bottle changes (such as due to counting the number of doses that have occurred).

In some embodiments, the controller and/or remote device may be configured to determine when the remaining amount of composition within a reservoir is below one or more thresholds. For example, the starting amount of overall composition within the one or more reservoirs can be known and the ongoing count can be used to determine a remaining amount of composition in the one or more reservoirs. In response to reaching or passing one or more of the thresholds, a notification (e.g., text, email, report, etc.) can be sent to a maintenance person as an indication that a refill is needed.

In some embodiments, one or more user inputs and/or sensors may be used to determined when a replacement reservoir has been installed. For example, a sensor may determine when the cover of the housing of the dispenser is opened and provide such an indication to the controller. Similarly, a sensor may indicate when a replacement reservoir has been installed directly on attachment features. In some embodiments, one or more weight sensors could be used to determine if a replacement reservoir has been installed within the dispenser. In some embodiments, a user may simply indicate, such as via the user interface, that a new replacement reservoir has been installed. Such sensor and user input indications can be used by the controller or remote device to know when a new replacement reservoir has been installed.

Example Compositions

The skin care product composition for use in the dispenser is described herein, but various elements of the composition may be substituted as will be understood by the skilled artisan. The dispenser as described can dispense any of the hereafter described compositions that can generate suitable amounts of dispensed foamed skin care product from concentrated skin care product compositions. The skin care concentrate and/or skin care product compositions as described herein can be concentrated and may provide from about 1.5 to about 20 times the concentration of surfactant that is currently available via handwashes on the market. According to one embodiment, the surfactant concentration in the skin care product composition is concentrated from 1.5 to 5 times the current product, for example, from about 2 to 3 or about 3 to 4 times the current product. According to another embodiment, the surfactant concentration of the skin care product composition described herein is between about 7% and 12% (e.g., about 0.023 g of surfactant for a 0.25 g dose), whereas the surfactant concentration in standard foam hand soap is approximately 2% (e.g., about 0.014 g of surfactant for a 0.7 g dose). According to yet another embodiment, the surfactant concentration of the skin care product composition described herein is between about 9% and 10%. In a particular embodiment, the surfactant concentration of the skin care product composition described herein is between about 8% and 9%.

In an embodiment, the skin care concentrate may comprise water, surfactant, additives, moisturizers, pH balancers, and the like. The skin care concentrate may be formed prior to combination with one or more propellants. In this embodiment, the total surfactant concentration of the skin care concentrate may be between about 7% and 12%. According to another embodiment, the surfactant concentration of the concentrate may be between about 9% and 10%. In a particular embodiment, the surfactant concentration of the concentrate may be about 9.6%.

Foaming the skin care product composition to make small doses appear larger allows the manufacturer to concentrate the amount of the active ingredient in the skin care composition resulting in equivalent benefits to the user while providing the manufacturer and customer significant benefits and savings. Suitable solvents to create concentrated skin care products are discussed further in Example 2.

Skin care concentrates and/or skin care product compositions for use in the dispenser include compositions comprising one or more anionic surfactants, zwitterionic surfactants, and/or nonionic surfactants to provide detergency. Use of particular surfactants in the composition may additionally lower the surface tension of the composition, provide improved foaming (i.e., serve as a foaming agent), serve as a wetting agent, emulsifier, or dispersant.

Anionic surfactants for use in the skin care concentrate and/or skin care product composition may include sulfates, sulfonates, sulfosuccinates, sarcosinates, phosphate esters, carboxylates, or any neutralized fatty acid. In some embodiments, suitable anionic surfactants may include alkyl sulfates, alkyl ether sulfates, alkyl monoglyceryl ether sulfates, alkyl sulfonates, alkylaryl sulfonates, sulfonated olefins, alkyl sulfosuccinates, alkyl ether sulfosuccinates, alkyl sulfosuccinates, isethionates, propyl peptide condensates, monoglyceride sufates, fatty glycerol. alkyl amidosulfosuccinates, alkyl carboxylates, alkyl amidoethercarboxylates, alkyl carbonates, alkyl succinates, fatty acid succinates, fatty acyl sarcosinates, fatty acyl amino acids, fatty acyl taurates, fatty alkyl sulfoacetates, alkyl phosphates, acyl lactylates, protein condensates, sodium lauryl sulfate, alkyl benzene sulfonate, sodium laureth sulfate, secondary alkane sulfonate (Paraffin sulfonate), the alkanesulfonates, the α-olefin sulfonates, the acyl isethionates, the acyl taurides, the acyl sarcosides, the sulfosuccinic acid monoalkyl ester salts and the alkyl polyglycol ether carboxylates in the form of their alkali metal, magnesium, ammonium or alkanolammonium salts, sodium lauroyl sarcosinate, surfactants derived from N-dodecyl-N,N-dialkanol amine, and mixtures of the same. In an embodiment, anionic surfactant(s) for use in the composition may be amphiphilic surfactants.

In an embodiment, the skin care concentrate and/or skin care product composition may comprise an anionic surfactant as a primary surfactant. In an embodiment, the skin care concentrate and/or skin care product composition may comprise between about 0.01% and about 10%, by weight, of the primary surfactant. In another embodiment, the skin care concentrate and/or skin care product composition may comprise between about 5% and about 8%, by weight, of the primary surfactant. In yet another embodiment, the skin care concentrate and/or skin care product composition may comprise between about 6% and about 7%, by weight, of the primary surfactant. In an embodiment, the primary surfactant in the skin care concentrate and/or skin care product composition comprises a sarcosinate. In a particular embodiment, the primary surfactant in the skin care concentrate and/or skin care product composition comprises sodium lauroyl sarcosinate.

Zwitterionic surfactants are characterized by having two distinct and opposite charges on the molecule at either adjacent or non-adjacent sites. The typical cationic group is a quaternary ammonium group, although other positively charged groups like sulfonium and phosphonium groups can also be used. The typical anionic groups are carboxylates and sulfonates, preferably sulfonates, although other groups like sulfates, phosphates and the like, can be used. Zwitterionic compounds for use in the skin care concentrate and/or skin care product composition may be amphoteric compounds, in an embodiment. Zwitterionic compounds for use in the skin care concentrate and/or skin care product composition may include amine oxides, betaines, sultaines, amphoacetate, for example, disodiumcocamphodiacetate, phosphobetaines, phosphitaines, including, for example, polybetaine polymers.

Amine oxide surfactants can include for example, lauramine oxide, tetradecamine oxide, cocoalkydimethyl amine oxide, octaamidopropyl aminie oxide and the like.

Betaine surfactants can include, for example, alkylbetaines and alkylamido betaines such as cocamidopropyl betaines, cocodimethylcarboxymethylbetaine, lauryldimethylcarboxymethylbetaine, lauryl betaine, lauryldimethylcarboxyethylbetaine, cetyldimethylcarboxymethylbetaine, lauramidopropyl betaine, lauryl-bis-(2-hydroxyethyl) carboxymethylbetaine, oleyldimethylgamma-carboxypropylbetaine, lauryl-bis-(2-hydroxypropyl)-carboxyethylebetaine, betaines derived from N-dodecyl-N,N-dialkanol amine, and the like.

In an embodiment, the skin care concentrate and/or skin care product composition may comprise a zwitterionic surfactant as a secondary surfactant. In an embodiment, the skin care concentrate and/or skin care product composition may comprise between about 0.01% and about 4%, by weight, of the secondary surfactant. In another embodiment, the skin care concentrate and/or skin care product composition may comprise between about 1% and about 2%, by weight, of the secondary surfactant. In an embodiment, the secondary surfactant in the skin care concentrate and/or skin care product composition comprises a betaine. In a particular embodiment, the secondary surfactant in the skin care concentrate and/or skin care product composition comprises lauryl betaine. Lauryl betaine may be particularly useful in preventing, reducing or avoiding buildup or residue which can interfere with discharge of the system.

In an embodiment, the ratio of the anionic surfactant (e.g. sodium lauroyl sarcosinate) to the zwitterionic surfactant (e.g. lauryl betaine) in the skin care concentrate and/or skin care product composition is between about 2:1 and about 4:1. In another embodiment, the ratio of the anionic surfactant (e.g. sodium lauroyl sarcosinate) to the zwitterionic surfactant (e.g. lauryl betaine) is between about 3:1 and about 4:1. In still another embodiment, the ratio of the anionic surfactant (e.g. sodium lauroyl sarcosinate) to the zwitterionic surfactant (e.g. lauryl betaine) is about 3.8:1. In an embodiment, amount of the zwitterionic surfactant (e.g. lauryl betaine) in the concentrate is between about 33% and about 50% of the amount of the anionic surfactant (e.g. sodium lauroyl sarcosinate) present in the concentrate.

Sultaines can include, for example, cocamidopropyl hydroxysultaines, cocodimethylpropyl sultaine, stearyldimethylpropyl sultaine, lauryl-bis-(2-hydroxyethyl) propylsultaine; and amidosultaines, for example, cocoamidodimethylpropylsultaine, stearylamidodimethylpropylsultaine, laurylamidobis-(2-hydroxyethyl) propylsultaine The phosphobetaines can include lauric-myristicamido-3-hydroxypropylphosphobetaine, cocoamidodisodium-3-hydroxypropylphosphobetaine, lauric-myristicamidodisodium-3-hydroxypropylphosphobetaine, lauric-myristicamidoglyceryl-phosphobetaine, lauric-myristicamidocarboxydisodium-3-hydroxypropylphosphobetaine, and the like. Phosphitaines can include, for example, cocoamidopropylmonosodiumphosphitaine, lauric-myristicamidopropylmonosodiumphosphitaine and the like.

Nonionic surfactants for use in the skin care concentrate and/or skin care product composition as described include, but are not limited to alkanol amines, alkanolamides, ethoxylated amides, ethoxylated fatty acids, ethoxylated fatty alcohols, alkoxylated esters, alkyl polyglucosides, for example, decyl polyglucoside, and lauryl polyglucoside, alkoxylated triglycerides, sorbitan esters, sorbitan ethers and polyethylene glycols, for example, Ceteth-2, Ceteth-20, Oleth-10, Oleth-20, Steareth-2, Steraeth-20, PEG-20 Stearate, PEG-100 Stearate, Polysorbate 20, Polysorbate 60, Polysorbate 80, fatty acid esters, ethyleneoxide/propyleneoxide copolymers, polyalcohols, ethoxylated polyalcohols, and the like.

In an embodiment, the skin care concentrate and/or skin care product composition of the invention may include a plurality of surfactants. In this embodiment, one or more of the plurality of surfactants may comprise anionic, zwitterionic and/or non-ionic surfactants. For example, two anionic surfactants may be utilized in the skin care concentrate and/or skin care product composition. As another example, one anionic surfactant and one zwitterionic surfactant may be utilized in the skin care concentrate and/or skin care product composition. As noted above, the composition may comprise between about 7% and 12%, between about 8% and 9%, or between about 9% and 10%, each by weight, of total surfactant (anionic, zwitterionic and non-ionic surfactants), in various embodiments.

In an embodiment, the shot or dose size of the skin care product composition described herein is about 0.2 g to about 0.3 g. In a particular embodiment, the shot or dose size of the skin care product composition is about 0.25 g. In an embodiment, the skin care product delivers between about 0.02 g and about 0.03 g of surfactant per dose. In another embodiment, the skin care product delivers about 0.023 g of surfactant per dose.

In an embodiment, the skin care concentrate and/or skin care product composition is a water-based formulation. In an embodiment, purified water is utilized as the skin care concentrate and/or skin care product composition base. In an embodiment, the skin care concentrate and/or skin care product composition may comprise between about 50% and about 99%, by weight, of water. In another embodiment, the skin care concentrate and/or skin care product composition may comprise between about 65% and about 85%, by weight, of water. In still another embodiment, the skin care concentrate and/or skin care product composition may comprise between about 75% and about 80%, by weight, of water.

Optional ingredients that may be added to the skin care concentrate and/or skin care product composition include, for example, emollients, fragrances, dyes, humectants, moisturizing agents, skin conditioning agents, chelating agents, preservatives, solvents, botanicals, vitamins, anti-oxidants, thickeners, skin protectants, pH modifiers, anti-corrosives, film formers, anti-inflammatories, abrasives, colorants, and the like.

Depending upon the embodiment, optional stabilizers may be used to inhibit reactions between ingredients and to maintain the homogeneity of the skin care concentrate and/or skin care product composition. According to one embodiment, the skin care concentrate and/or skin care product composition includes one or more foam stabilizers. Suitable foam stabilizers can be chosen from foam boosters, alkyl polyglucosides, amphoteric surfactants, nonionic surfactants, amide oxides, polymer particles, salt (sodium chloride, calcium chloride, and magnesium chloride), polymers (carboxylate, methacrylate, etc.), gums (xanthan gum, guar gum, locust bean gum), and carrageenan. In embodiments, the stabilizer may be present in the skin care concentrate and/or skin care product composition in an amount of from about 0% to about 10%, for example from about 0.01% to about 5%, for example, from about 0.01% to about 2%.

Appropriate solubilizers for use in the skin care concentrate and/or skin care product composition as described will be readily apparent to the skilled artisan and can include hydrotropes, chelating agents, builders, and the like. The solubilizer may be present in the skin care concentrate and/or skin care product composition in an amount of from about 0% to about 65%, for example, from about 0% to about 40%, for example, from about 0.1% to about 30%.

Generally, emollients lubricate, soothe, and soften the skin surface. Exemplary emollients include silicones, dimethicone, ethoxylated or propoxylated oily or waxy ingredients such as esters, ethers, fatty alcohols, hydrocarbons, lanolin, mineral oil, vegetable oil, and the like. Emollients may be present in the skin care concentrate and/or skin care product composition in an amount of from about 0% to about 10%, for example, from about 0.1% to about 3%, for example, from about 0.05% to about 1%.

Humectants are hydroscopic agents that are widely used as moisturizers. Their function is generally to prevent the loss of moisture from the skin and to attract moisture from the environment. Humectants may also aid in preventing bridging across the outlet tubing of the inventive apparatus. Humectants that may be useful in the skin care concentrate and/or skin care product composition include, for example, polyols, sodium PCA, glycerine, glycols, propylene glycol, butylene glycol, betaine, sodium hyaluronate, hyaluronic acid, sodium lactate, sorbitol, urea, hydroxyethyl urea, and the like. Humectants may be present in the skin care concentrate and/or skin care product composition in an amount of from about 0% to about 5.0%, for example, from about 0.1% to about 2.5%, for example, from about 0% to about 0.5%. In a particular embodiment, the skin care product composition may comprise between about 0.75% and 1.0%, by weight, of humectant. In a particular embodiment, the skin care concentrate may comprise between about 0.75% and 1.5%, by weight, of humectant.

In an embodiment, glycerine may be utilized as a humectant and may be present in the skin care concentrate and/or skin care product composition in an amount of from about 0% to about 5.0%, for example, from about 0.1% to about 2.5%, for example, from about 0% to about 0.5%. In a particular embodiment, the skin care product composition may comprise between about 0.75% and 1.0%, by weight, of glycerine. In a particular embodiment, the skin care concentrate may comprise between about 0.75% and 1.5%, by weight, of glycerine.

Preservatives for increasing the shelf life of the skin care product composition or inhibiting corrosion may also be used. Exemplary suitable preservatives include, but are not limited to sodium benzoate, disodium EDTA; tetrasodium EDTA; iodopropynyl butylcarbamate; benzoic esters (parabens), such as methylparaben, propylparaben, butylparaben, ethylparaben, sodium methylparaben, and sodium propylparaben; phenoxyethanol; benzyl alcohol; phenethyl alcohol; imidazolidinyl urea; diazolidinyl urea; citric acid, lactic acid, Kathon™ CG (active ingredients comprising two isothiazolinones: 5-chloro-2-methyl-4-isothiazolin-3-one and 2-methyl-4-isothiazolin-3-one), phenoxyethanol, 2-bromo-2 nitro-propane-1,3,-diol, potassium sorbate, and the like. Preservatives can be present in the skin care concentrate and/or skin care product composition in an amount of from about 0.01% to about 3%, for example, from about 0.05% to about 1.0%, from about 0.04% to about 0.3%, or from about 0.05% to about 0.25%.

Suitable skin conditioning agents include, for example, hydrolyzed plant proteins such as hydrolyzed wheat protein, hydrolyzed soy protein, hydrolyzed collagen, and the like. Skin conditioning agents can be present in the skin care concentrate and/or skin care product composition in an amount of from about 0% to about 10%, for example, from about 0% to about 1%, for example, from about 0.0% to about 0.5%.

pH modifiers may include both basic and acidic pH modifiers. pH modifiers may additionally provide corrosion inhibition. Some examples of basic pH modifiers that may be used in the skin care concentrate and/or skin care product composition of the present disclosure include, but are not limited to, aminomethylpropanol, ammonia; sodium, potassium, and lithium hydroxide; sodium, potassium, and lithium metal silicates; monoethanolamine; triethylamine; isopropanolamine; ethanolamine; and triethanolamine. Acidic pH modifiers that may be used in the formulations of the present disclosure include, but are not limited to, mineral acids; carboxylic acids; and polymeric acids, including by way of example, citric acid or lactic acid. The pH modifiers will be used in an amount necessary to achieve the desired pH. For example, the pH modifiers can be present in the skin care composition in an amount of from about 0% to about 5%, for example, from about 0.05% to about 3%, for example, from about 0.01% to about 2%. In an embodiment, the pH modifiers can be present in the skin care composition or concentrate in an amount between about 0.2% and 0.35%.

A chelating agent is a substance whose molecules can form one or more bonds with a metal ion. In particular, water that may be contained in the skin care composition often contains metal ions, such as calcium, magnesium, and iron ions, that might react with anionic components (e.g., acids)

present within the composition. Also, reduction in iron can reduce the ability of microbes to obtain oxygen for respiration, so low iron compositions tend to be easier to preserve. Some examples of chelating agents that may be used in the skin care composition of the present disclosure include, but are not limited to, ethylenediamines, ethylenediaminetetraacetic acids (EDTA) acids and/or salts thereof, for example, tetrasodium EDTA, citrate, pyrithione, N,N'-bis(o-hydroxybenzyl)ethylenediamine-N,N'diacetic acid; ethylenebis-N,N'-(2-o-hydroxyphenyl)glycine, 1,3-diaminopropane-N,N,N',N'-tetraacetic acid; ethylenediamine-N,N'-diacetic acid; ethylenediamine-N,N'-dipropionic acid dihydrochloride; ethylenediamine-N,N'-bis(methylenephosphonic acid); N-(2-hydroxyethyl)ethylenediamine-N,N',N'-triacetic acid; ethylenediamine-N,N,N',N'-tetrakis(methylenephosponic acid); O,O'-bis(2-aminoethyl)ethyleneglycol-N,N,N,N'-tetraacetic acid; N,N-bis(2-hydroxybenzyl) ethylenediamine-N,N-diacetic acid; 1,6-hexamethylenediamine-N,N,N',N'-tetraacetic acid; N-(2-hydroxyethyl)iminodiacetic acid; iminodiacetic acid; 1,2-diaminopropane-N,N,N',N'-tetraacetic acid; nitrilotriacetic acid; nitrilotripropionic acid; nitrilotris(methylenephosphonic acid); and triethylenetetramine-N,N,N',N'',N''',N'''-hexaacetic acid, glucuronic acids and/or salts thereof, succinic acid and/or salts thereof, polyphosphates, organophosphates, and the like. Additionally, chelating agents can potentiate the antimicrobial efficacy of benzalkonium chlorides at lower pH, so the addition of the chelating agent may require reducing the concentration of the benzalkonium chloride active ingredient. This reduction in active concentration can reduce cost, as well as improving skin safety. The chelating agent can be present in the skin care concentrate and/or skin care product composition in an amount of from about 0% to about 5%, for example, from about 0.01% to about 3%, for example, from about 0.5% to about 2%.

Fragrances and dyes may be used in the skin care concentrate and/or skin care product composition as appropriate to appeal to the purchasing consumer. Fragrances and dyes can be present in the skin care concentrate and/or skin care product composition in an amount of from about 0% to about 5%, for example, from 0% to about 1%, for example, from about 0% to about 1.0%.

Moisturizing agents for use in the skin care concentrate and/or skin care product composition as described can include, but are not limited to collagen; lecithins; liposomes; peptides; polysaccharides; glycerine; sorbitol; propylene glycol; calcium pantothenate; urea; caprylyl glycol; butylene glycol; glucose; magnesium lactate; potassium chloride; potassium lactate; ethylhexylglycerin; dipropylene glycol; silicones, such as dimethicone and cyclomethicone; fatty acids, for example, lanolin acid; fatty alcohols, for example, lanolin alcohol; hydrocarbon oils and waxes; petrolatum; polyhydric alcohols; sterols, for example, cholesterol; vegetable and animal fats, for example, cocoa butter, vegetable waxes, carnauba wax, wax esters, and bees wax; hyaluronic acid, ceramics; caprylic/capric triglycerides; magnesium aspartame; potassium aspartame; sarcosine; and the like. The moisturizing agent can be present in the skin care concentrate and/or skin care product composition in an amount of from about 0% to about 10%, for example, from about 0% to about 5%, for example, from about 0% to about 1%.

Botanicals for use in the skin care concentrate and/or skin care product composition as described may include, for example, aloe vera, green tea extract, cucumber extract, chamomile, oat, Aspen Bark, Bamboo Leaf, Banaba Leaf, Burdock Root, Chamomile, *Chrysanthemum*, Cucumber Peel, *Ginkgo Biloba* Leaf, *Ginseng* Root, Grape Seed, Green Tea, Honey Suckle Flower, Horse Chest Nut, Licorice Root, Maca, Milk Thistle (Silymarin), Olive Leaf, Rosehips, Rosemary, Sacha Inchi, Sea Buckthorn, Sunflower, Thyme, White Willow Bark, and the like. Botanicals can be present in the skin care concentrate and/or skin care product composition in an amount of from about 0% to about 5%, for example, from about 0% to about 3%, for example, from about 0% to about 1%.

Vitamins for use in the skin care concentrate and/or skin care product composition may include for example, Vitamins A, B, C, D, E, tocopherols, tocopheryl acetate, retinyl palmitate, panthenol, and ascorbic acid. Vitamins can be present in the skin care concentrate and/or skin care product composition in an amount of from about 0% to about 5%, for example, from about 0.1% to about 3%, for example, from about 0.1% to about 1%.

Antioxidants for use in the skin care concentrate and/or skin care product composition as described can include one or more of Glutathione, superoxide dismutase, ubiquinone, omega-fatty acids, Vitamin C, Beta-Glucan, Thioctic Acid, Magnesium Ascorbyl, Phosphate, Ferulic Acid, Superoxide Dismutase, Epigallocatechin Gallate, Ergothioneine, Glutathione, Xanthophylls, and the like. Antioxidants may be present in the skin care concentrate and/or skin care product composition in an amount of from about 0% to about 5%, for example, from about 0% to about 3%, for example, from about 0% to about 1%.

Propellants for use in the skin care product composition as described can include any art recognized propellants. In an embodiment, the propellant system comprises a plurality of propellants. In other embodiments, the propellant system comprises a single propellant. In an embodiment, the propellant system of the invention comprises a primary propellant and a secondary propellant. In this embodiment, the propellant system may comprise a greater concentration of the primary propellant than the secondary propellant.

According to one embodiment, the skin care product composition comprises a propellant that does not dissolve in the water-based soap system. According to one embodiment, these non-dissolving solvents can be a dispersion of droplets that are blends of propellants such that the droplet density is about the same as the hand wash composition's density. Non-dissolving solvents may be chosen from one or more of isobutane, isopentane, HFC (hydrofluorocarbons) 132A, or HFC 152a.

In an embodiment, at least one of the propellants utilized in the skin care product composition may comprise a hydrocarbon. Hydrocarbon propellants are environmentally acceptable and have a low toxicity. In an embodiment, the hydrocarbon propellant may be selected from propane ($C_3H_8$; known as "A-108"), butane ($C_4H_{10}$; "A-17"), isobutane ($C_4H_{10}$; "A-31"), and combinations thereof (i.e. isobutane/propane mixture "A-46"). In an embodiment, any "A" series hydrocarbon may be utilized as a propellant in the invention.

According to another embodiment, the propellant for use in the skin care product composition as described is a solvent which at least partially dissolves in the skin care concentrate or is somewhat water-soluble, such as dimethyl ether. Dimethyl ether, for example, may dissolve to a degree of about 10% to about 30%, depending on temperature and pressure. These propellants may at least partially dissolve in the aqueous soap system and form foam as they are vaporized upon the release of pressure. According to another embodiment, the propellant may be a combination of non-dissolving propellant and an at least partially dissolving propellent.

In an embodiment, at least one of the propellants used in the skin care product composition may comprise an ether. In a particular embodiment, at least one of the propellants used in the skin care product composition may comprise a $C_1$-$C_6$ alkyl ether. In an embodiment, at least one of the propellants used in the skin care product composition may comprise dimethyl ether or diethyl ether.

Propellants may be present in the composition in an amount of from about 5% to about 60%, for example, from about 20 to about 40%, for example, from about 30 to about 40% of the total skin care product composition. In a particular embodiment, the skin care product composition may comprise between about 10% and about 15%, by weight, of propellant(s). In still another embodiment, the skin care product composition may comprise between about 15% and about 20%, by weight, of propellant(s). In one embodiment, the skin care product composition may comprise about 12%, by weight, of propellant(s). An appropriate amount of solvent may be estimated using the molecular weight of the solvent, the desired volume, the ideal gas law, and the concentration.

In an embodiment, the propellants utilized in the skin care product composition comprise isobutane and dimethyl ether. In this embodiment, the total weight percentage of the isobutane may be less than the weight percentage of the dimethyl ether. In this embodiment, the dimethyl ether may comprise a primary propellant and isobutane may comprise a secondary propellant. In an embodiment, the skin care product composition may comprise about 3%, by weight, of isobutane propellant and about 9%, by weight, of dimethyl ether propellant. In other embodiments, the skin care product composition may comprise between about 1% and 5%, by weight, of isobutane propellant and about 5% and 15%, by weight, of dimethyl ether propellant.

In an embodiment, the ratio of hydrocarbon propellant (e.g. isobutane) to $C_1$-$C_6$ alkyl ether propellant (e.g. dimethyl ether) in the skin care product composition is in the range of about 2:3 to about 1:9. In an embodiment, the ratio of hydrocarbon propellant (e.g. isobutane) to $C_1$-$C_6$ alkyl ether propellant (e.g. dimethyl ether) is in the range of about 1:4 to about 1:2. In an particular embodiment, the ratio of hydrocarbon propellant (e.g. isobutane) to $C_1$-$C_6$ alkyl ether propellant (e.g. dimethyl ether) is about 1:3. In an embodiment, the propellant, prior to mixing with the skin care concentrate, may comprise between about 10% and about 40% isobutane and between about 60% and 90% dimethyl ether.

In an embodiment, isobutane may not be soluble with the skin care concentrate and the skin care product composition may exist in a liquid/vapor phase within the dispenser. The isobutane may float above the surface of the liquid skin care concentrate in an embodiment. In an embodiment, the dimethyl ether may partially dissolve in the skin care concentrate. In an embodiment, about 10% to about 30% of the dimethyl ether may dissolve in the skin care concentrate. In an embodiment, the choice of surfactant and/or the amount of surfactant in the skin care concentrate may increase the dissolution of the dimethyl ether into the skin care product composition.

The inventors have advantageously discovered that use of the propellant combination of isobutane and dimethyl ether in the skin care product composition provides a luxurious foam which blooms to multiple times its original volume upon entering atmospheric pressure. In an embodiment, the propellant combination of isobutane and dimethyl ether, in combination with one or more surfactants in the skin care product composition, causes the skin care product composition to bloom to at least twice its original volume upon entering atmospheric pressure. It is believed that the inclusion of dimethyl ether in the propellant component of the skin care product composition allows the foam to retain its volume without quickly collapsing.

In an embodiment, due to the propellant components, a dose of skin care product composition (which may comprise about 0.2 g to about 0.3 g and, in some embodiments, about 0.25 g) foams to form a skin care product which comprises about 5 cc to about 9 cc of foam. In an embodiment, the skin care product composition (which may comprise about 0.2 g to about 0.3 g and, in some embodiments, about 0.25 g) foams to form a skin care product which comprises about 7 cc of foam. In an embodiment, due to the propellant components, a dose of skin care product composition (which may comprise about 0.2 g to about 0.3 g and, in some embodiments, about 0.25 g) foams to form a skin care product which comprises about 7 mL to about 12 mL of foam. In an embodiment, due to the propellant components, a dose of skin care product composition (which may comprise about 0.2 g to about 0.3 g and, in some embodiments, about 0.25 g) foams to form a skin care product which comprises about 10 mL of foam.

In an embodiment, the skin care product composition of the invention may be homogeneous (concentrate is completely miscible with the propellant(s)) or may be heterogeneous (part or all of the concentrate is immiscible with the propellant(s)). In homogeneous systems, the system may comprise a liquid phase and a vapor phase. In heterogeneous systems, the system may comprise two liquid phases and a vapor phase or may comprise an emulsion phase and a vapor phase.

The artisan skilled in the formulation of skin care products and soaps understands that ingredients may be selected to provide more than one function in a composition. Thus, a single ingredient may be chosen to act, for example, as a pH modifier and a preservative, or as a moisturizer and as a humectant.

Example Gas Generation Chemistry

The skin care product composition may be foamed by the creation of a gas which when released in, or mixed with, the skin care product generates the foamed skin care product that is dispensed from the dispenser. The gas may be generated by one or more gas generation chemistries or one or more dissolved low boiling point solvents.

According to one embodiment, the gas for foaming the skin care product composition is generated by dissolving one or more low boiling point solvents for example, isobutane (boiling point of about 11° F.), isopentane (boiling point of about 82° F.), pentene (boiling point of about 86° F.), pentane (boiling point of about 97° F.), diethyl ether (boiling point of about 94° F.), neopentane (boiling point of about 50° F.), and HFCs including tetrafluoro-ethane and difluoro ethane in the skin care product composition in a pressurized container. Upon ejection of the skin care product composition from the pressurized container, the solvent will vaporize or boil (generating vapor) causing bubbles to be formed in the skin care product composition resulting in foam.

Skin care product compositions for use in the dispensers as described preferably having a viscosity of less than about 5000 centipoise (cP), for example, from about 10 cP to about 5,000 cP.

Example Single Reservoir System

FIG. 7 illustrates a schematic diagram of an example single reservoir system that can be utilized by various example embodiments of the present invention. In this regard, for example, the foam skin care product (e.g., soap) dispenser may include components corresponding to various embodiments described herein. The example dispenser 300 may comprise hardware and/or software capable of performing functions described herein. In this regard, the dispenser 300 may include a controller 372, a memory 374, a communication interface 376, a user interface 378, an activation sensor 375, a power supply 377, other system(s)/sensor(s) 379, a reservoir 352, a check valve 334, a dispense valve 320, a dispense outlet 312, and flow path structures 382, 386, 392. In addition, though not shown here, various other components may be included in example dispensers 300, such as various sensors, additional flow path structures, or chambers.

The reservoir 352 may be any type of container that is configured to hold an amount of skin care product composition and propellant composition under pressure. In some embodiments, the reservoir 352 may hold a skin care product composition. In this regard, the propellant(s) within the skin care product composition may have a vaporization point above the temperature/pressure at which it is held within the reservoir 352 such that it remains in liquid form while held therein. Further, in some embodiments, the reservoir 352 may include an expanding solvent dissolved in the skin care product composition. The expanding solvent dissolved within the skin care product composition in the reservoir 352 may expand as the skin care product composition is released through the dispense valve 320. As noted herein, the propellant maintaining a consistent pressure within the reservoir 352 may enable a constant flow rate through the dispense valve 320.

Figure 10:
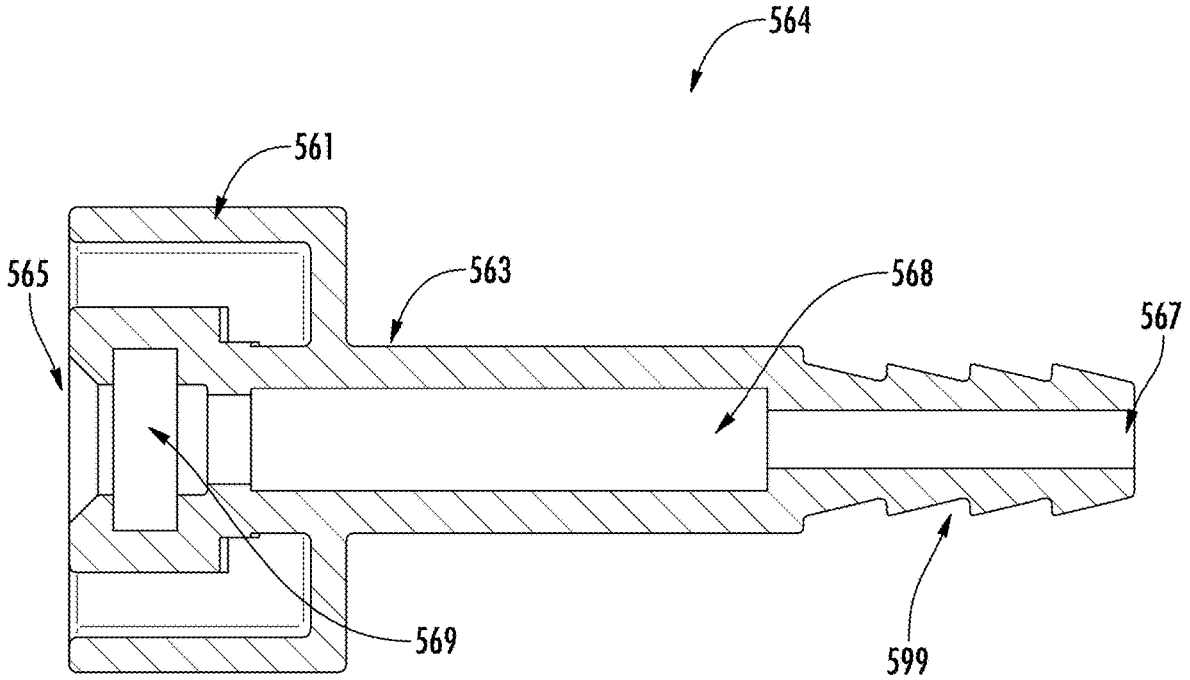
FIG. 10 illustrates a cross-sectional view of an example connector for attachment of a reservoir, in accordance with some example embodiments described herein.

The reservoir 352 may be configured to removably attach to the dispenser 300, such as a housing of the dispenser 300 and/or to a connector like the connector 165, 564 shown and described with respect to FIGS. 3 and 10, respectively. The reservoir 352 may have an open configuration and a closed configuration. In the closed configuration, the contents of the reservoir 352 may be held within the reservoir. However, when in the open configuration, the contents may be allowed to flow therefrom. In this regard, upon connection, the reservoir 352 may be transitioned to the open configuration such that the skin care product composition and the propellant composition may flow into the connected flow path structures 382 and 386. In this regard, the connector may include one or more features that maintain the reservoir 352 in the open configuration when it is connected, while still allowing removable attachment and detachment.

The dispenser 300 may include a check valve 334 that is in fluid communication with the reservoir 352 when it is installed (e.g., the flow path structure 382 leads from an opening in the reservoir 352 to the check valve 334). The check valve 334 may be configured to enable flow of the liquid skin care product composition therethrough without enabling reverse flow back therethrough. Further, the check valve 334 may be positioned upstream of the dispense valve and such that the pressure within the reservoir 352 is maintained through the check valve and the flow path structures 382, 386 (e.g., tubing) upstream of the dispense valve 320. In some embodiments, by preventing flow back through the check valve 334, the check valve 334 provides the benefit of being able to remove and replace the reservoir 352 without leakage of any remaining skin care product composition that is within the flow path structure 386 (e.g., when the reservoir 352 has been removed and the pressure drops upstream of the flow path structure 386). In some embodiments, there may be no need for a check valve 334. For example, some of the functionality of the check valve 334 may be incorporated in the dispense valve 320.

As noted herein, skin care product composition within the flow path structures 382, 386 may be held under the same pressure associated with the skin care product composition within the reservoir 352. In this regard, the portion of the flow path leading to the dispense valve 320 may maintain a pressure range of 50 psi-75 psi. However, as described herein, when the dispense valve 320 transitions to an open configuration, the portion of the skin care product composition released past the dispense valve 320 may undergo a pressure drop to approximately 14.7 psi (e.g., atmospheric pressure)—as the flow path structure 392 downstream of the dispense valve 320 may be open to the environment (such as through the dispense outlet 312). In this regard, the flow path structures 382, 386 may maintain the skin care product composition held therein at a greater pressure than the flow path structure 392. In some embodiments, different types of flow path structures or different characteristics of flow path structures may be chosen for flow path structures 382, 386 versus flow path structure 392 accordingly.

The dispense valve 320 may be any type of valve that can be opened or closed to enable the skin care product composition to flow therethrough. For example, the dispense valve 320 may be a solenoid valve or metered valve that can be opened or closed, such as via the controller 372. For example, in response to receiving user input from the activation sensor 375, the controller 372 may be configured to open the dispense valve 320 to enable skin care product composition to flow into the dispense flow path structure 392 (e.g., tubing) toward the dispense outlet 312. Upon being released, the pressure drop causes the released skin care product composition to form foam skin care product for dispensing through the dispense outlet 312.

As noted herein, due to the high concentration of skin care product composition, it is important to accurately dispense the desired amount of skin care product composition (e.g., weight and volume) with each dispense. In this regard, while some typical soap dispensers utilize mechanical pumps to dispense approximately 0.7 g-1 g of skin care product composition per dose, some embodiments of the present invention contemplate accurately dispensing 0.4 g per dose or less (e.g., 0.2 g), which may be accomplished by utilizing a metered valve or a solenoid valve. Notably, since the amount of skin care product composition being released is so small, accuracy may be important because variations in the amount being released can cause an undesirable over-dispensing (e.g., overwhelming) or under-dispensing (e.g., insufficient) amount of foam skin care product being dispensed to a user.

In this regard, in some embodiments, the controller 372 may be configured to operate the dispense valve 320 for a specific amount of time to ensure accurate amounts of skin care product composition are released. As noted above, the amount of time the controller 372 opens the dispense valve 320 may remain constant over the life of the reservoir 352 because the pressure within the reservoir 352 remains constant (e.g., due to the presence of the propellant). In this regard, in some such embodiments, there may not be a need to change the length of time the dispense valve 320 is open over time (e.g., increasing over time) because the pressure remains constant, as opposed to other systems where the pressure decreases in the reservoir as the contents deplete. In those cases, the open time of the dispense valve may need to be increased as time goes on in order to ensure the same amount of skin care product composition is released whether it is the first dose from the reservoir or the last dose from the reservoir.

In some embodiments, the controller 372 may be configured to open the dispense valve 320 for different amounts of time to enable different dose sizes of foam skin care product to ultimately be dispensed from the dispenser. For example, the dispenser 300 may be configured to dispense different amounts of foam skin care product (e.g., small, medium, large, etc.). A user (e.g., a maintainer) may set the desired amount, such as through the user interface 378.

In some embodiments, the controller 372 may be configured to open the dispense valve 320 for longer periods of time as the reservoir 352 empties, to enable larger dose sizes of foam skin care product to be dispensed from the dispenser over time. This may be advantageous as rapid evacuation of the skin care product composition may cool or significantly cool the reservoir 352. If so, the liquid portion of the propellant(s) may not vaporize quickly enough to maintain constant pressure within the reservoir 352. Likewise, when most of the skin care product composition has been dispensed, a liquid propellant phase may cease to exist and the reservoir 352 may experience a gradual decrease in internal pressure. If the pressure inside the reservoir 352 drops, a greater amount of skin care product composition may need to be dispensed.

The controller 372 may be any means configured to execute various programmed operations or instructions stored in a memory device (e.g., memory 374) such as a device or circuitry operating in accordance with software or otherwise embodied in hardware or a combination of hardware and software, thereby configuring the device or circuitry to perform the corresponding functions of the controller 372 as described herein. The memory 374 may be any suitable form of memory such as an EPROM (Erasable Programmable Read Only Memory) chip, a flash memory chip, a disk drive, or the like. As such, the memory may store various data, protocols, instructions, computer program code, operational parameters, etc. In this regard, controller 372 may include operation control methods embodied in application code. These methods are embodied in computer instructions written to be executed by one or more processors, typically in the form of software. The software can be encoded in any suitable language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

In this regard, in some embodiments, the controller 372 may be configured to execute computer program code instructions to perform aspects of various embodiments of the present invention described herein. For example, the controller 372 may be configured to control opening and closing of the dispense valve 320, such as for predetermined time periods. In some embodiments, the controller 372 may be configured to determine when user input is received indicating a desire to cause a dispense (such as to the activation sensor 375) and, in response, cause the dispense valve 320 to open for the predetermined period of time. In some embodiments, the controller 372 may be configured to count the number of dispenses, which may correspond to a reservoir 352 such that an amount of remaining skin care product composition within the reservoir may be determined. In some embodiments, such data and other data can be monitored and transmitted (e.g., via the controller 372), such as through the communication interface 376 to a remote device. In some embodiments, the controller 372 may be configured to perform various other functions, such as through interaction with various other components (e.g., the power supply 377 (e.g., monitor power supply), the user interface 378, etc.).

The memory 374 may be configured to store instructions, computer program code, usage data, and other data/information associated with the dispenser 300 in a non-transitory computer readable medium for use, such as by the controller 372.

The communication interface 376 may be configured to enable connection to external systems (e.g., remote system(s)/device(s)). In some embodiments, the communication interface 376 may comprise one or more transmitters configured to transmit, for example, one or more signals according to example embodiments described herein. Likewise, the communication interface 376 may include at least one receiver configured to, for example, receive data according to example embodiments described herein. In some embodiments, the transmitter and receiver may be combined as a transceiver. In this regard, the dispenser 300 may be configured for wired and/or wireless communication. In some embodiments, the communication interface 376 may comprise wireless capabilities for WiFi, Bluetooth, low-power wide-area network (LPWAN), or other wireless protocols.

The user interface 378 may be configured to receive input from a user and/or provide output to a user. The user interface 378 may include, for example, a display, a keyboard, keypad, function keys, mouse, scrolling device, input/output ports, touch screen, or any other mechanism by which a user may interface with the system. Although the user interface 378 is shown as being directly connected to the controller 372 and within the dispenser 300, the user interface 378 could alternatively be remote from the controller 372 and/or dispenser 300. Likewise, in some embodiments, other components of the dispenser 300 could be remotely located.

The activation sensor 375 may be configured to receive user input indicating a desire to initiate a dispense of the skin care product. In some embodiments, the activation sensor 375 may be configured to detect a presence of an object, such as a hand of a user. The activation sensor 375 may be any type of sensor, such as a capacitive sensor, a pressure sensor, a time-of-flight sensor, an infrared sensor, etc. In some embodiments, the activation sensor may be a mechanism or other mechanical sensor or feature, such as a lever or a button. The activation sensor 375 may be in communication with the controller 372 and configured to transmit sensor data to the controller 372 for use thereof.

The power supply 377 may include an internal and/or external power supply that is configured to supply power to various components of the dispenser 300 (e.g., the dispense valve 320, the user interface 378, etc.). In some embodiments, the power supply 377 may include one or more batteries, which may be replaced and/or recharged. In some embodiments, the power supply 377 may be an external power supply, such as a wall outlet.

The dispenser 300 may include other system(s)/sensor(s) 379 that may be configured to perform various functions, such as monitoring or measuring—which may be used with embodiments described herein. For example, the dispenser 300 may include a reservoir replacement switch and/or sensor that is configured to detect when a new reservoir is positioned within the dispenser 300 (e.g., replacing an empty reservoir). In some embodiments, the switch/sensor may be configured to receive user input indicating that the new reservoir has been installed. In some embodiments, the switch/sensor may detect, such as through detecting the connection of the reservoir to the housing and/or through a non-touch sense (e.g., light, capacitance, etc.). As another example, the dispenser 300 may include a cover switch or sensor that is configured to determine when a cover of a housing of the dispenser 300 is opened and/or closed. As appreciated based on the various embodiments described herein, other system(s)/sensor(s) 379 are contemplated.

Example Multi-Reservoir System

FIG. 8 illustrates a schematic diagram of an example multiple (e.g. dual) reservoir system that can be utilized by various example embodiments of the present invention. In this regard, for example, the foam skin care product (e.g., soap) dispenser 400 may include components corresponding to various embodiments described herein (such as the components described with respect to FIG. 7 where appropriate). The example dispenser 400 may comprise hardware and/or software capable of performing functions described herein. In this regard, the dispenser 400 may include a controller 472, a memory 474, a communication interface 476, a user interface 478, an activation sensor 475, a power supply 477, other system(s)/sensor(s) 479, a first reservoir 452, a first check valve 434, a second reservoir 454, a second check valve 436, a dispense valve 420, a dispense outlet 412, and flow path structures 482, 484, 486, 488, 492. In addition, though not shown here, various other components may be included in example dispensers 400, such as various sensors, additional flow path structures, or chambers.

The first reservoir 452 (e.g., "Reservoir A") may be any type of container that is configured to hold an amount of a skin care product composition under pressure. Likewise, the second reservoir 454 (e.g., "Reservoir B") may be any type of container that is configured to hold an amount of skin care product composition under pressure. In some embodiments, both reservoirs may each be independently capable of being utilized to perform a dispense of foam skin care product from the dispenser. For example, the example single reservoir system described above may be configured to hold two reservoirs, such that dispensing may occur from either reservoir. In such an example embodiment, a controller may be configured to control which reservoir is being dispensed from (such as using a switch or two separate dispense valves). Alternatively, both reservoirs could be dispensed from simultaneously, which may allow for a portion of the desired dose of skin care product to be taken from each reservoir. Further, a dispense count could be tallied and/or sensor(s) could be used to monitor/estimate the amount of skin care product composition remaining in each reservoir. Thus, when one reservoir is considered empty, the controller cause dispensing from the other reservoir—thereby giving a maintainer a chance to replace the empty reservoir while the other reservoir is still able to provide foam skin care product dispenses. In some such embodiments, the controller may cause a corresponding notification to be sent to the maintainer once one of the reservoirs is determined to be empty to aid in timely replacement.

Figure 9:
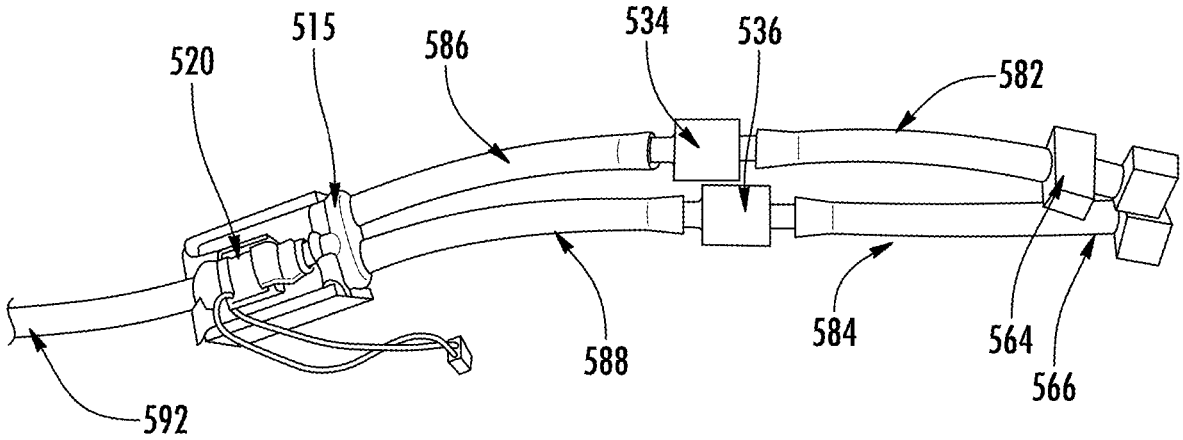
FIG. 9 shows a detailed view of a portion of an example foam skin care product dispenser including two reservoirs, in accordance with some example embodiments described herein.

The first and second reservoirs 452, 454 may each be configured to removably attach to the dispenser 400, such as a housing of the dispenser 400 and/or to a connector, like the connectors 564, 566 shown and described with respect to FIG. 9. The first and second reservoir(s) 452, 454 may each have an open configuration and a closed configuration. In the closed configuration, the contents of the reservoirs may be held within the reservoir. However, when in the open configuration, the contents may be allowed to flow therefrom (e.g., depending on pressure differentials, etc.). In this regard, upon connection, the first and second reservoirs 452, 454 may each be transitioned to the open configuration such that the skin care product compositions and the propellants may flow into the connected flow path structures 482, 484, respectively. In this regard, the connectors may include one or more features that maintain the reservoirs in the open configuration when connected, while still allowing removable attachment and detachment.

In some embodiments, the first and second reservoirs 452, 454 may be separately installed, such as to enable replacement of one reservoir without replacement of the other. In some embodiments, the first and second reservoirs 452, 454 may be configured to be installed together, such as in an attached form, which may require a user to install/replace both reservoirs.

The dispenser 400 may include a check valve for each reservoir. For example, a first check valve 434 (e.g., "Check Valve A") may follow the first flow path structure 482 leading from the first reservoir 452 to the dispense valve 420. Similarly, a second check valve 436 (e.g., "Check Valve B") may follow the second flow path structure 484 leading from the second reservoir 454 to the dispense valve 420. The check valves 434, 436 may be configured to enable flow of the skin care product compositions and propellants from each of the reservoirs therethrough without enabling reverse flow back therethrough. Further, the check valves 434, 436 may be positioned upstream of the dispense valve 420 and such that the pressure within the first and second reservoirs 452, 454 is maintained through the check valves 434, 436 and the flow path structures 482, 484, 486, 488, (e.g., tubing). In some embodiments, by preventing flow back through the check valves 434, 436, the check valves 434, 436 provide the benefit of being able to remove and replace each reservoir 452, 454 without leakage of any remaining skin care product composition and/or propellant composition that is within the flow path structures 486, 488 (e.g., when one of the reservoirs 452, 454 has been removed and the pressure drops upstream).

In some such embodiments, the pressure may be consistent or nearly consistent between the first and second reservoirs 452, 454. In some embodiments, the pressure may be allowed to equalize between the two reservoirs.

The dispense valve 420 may be any type of valve that can be opened or closed to enable the skin care product composition and propellant composition to flow therethrough. For example, the dispense valve 420 may be a solenoid valve or metered valve that can be opened or closed, such as via the controller 472. For example, in response to receiving user input from the activation sensor 475, the controller 472 may be configured to open the dispense valve 420 to enable skin care product composition and propellant composition to flow into the dispense flow path structure 492 (e.g., tubing) toward the dispense outlet 412.

Similar to the embodiments described with respect to FIG. 4, the controller 472 may be configured to operate the dispense valve 420 for a specific amount of time to ensure accurate amounts of skin care product composition and propellant composition are released. As noted above, the amount of time the controller 472 opens the dispense valve 420 may remain constant over the life of the reservoirs 452, 454 because the pressure within the reservoirs 452, 454 remain constant (e.g., due to the expanding solvent or other means). In some embodiments, the controller 472 may be configured to open the dispense valve 420 for different amounts of time to enable different dose sizes of foam skin care product to be dispensed. For example, the dispenser 400 may be configured to dispense different amounts of foam skin care product (e.g., small, medium, large, etc.). A user (e.g., a maintainer) may set the desired amount, such as through the user interface 478.

The controller 472 may be any means configured to execute various programmed operations or instructions stored in a memory device (e.g., memory 474) such as a device or circuitry operating in accordance with software or otherwise embodied in hardware or a combination of hardware and software, thereby configuring the device or circuitry to perform the corresponding functions of the controller 472 as described herein. The memory 474 may be any suitable form of memory such as an EPROM (Erasable Programmable Read Only Memory) chip, a flash memory chip, a disk drive, or the like. As such, the memory may store various data, protocols, instructions, computer program code, operational parameters, etc. In this regard, controller 472 may include operation control methods embodied in application code. These methods are embodied in computer instructions written to be executed by one or more processors, typically in the form of software. The software can be encoded in any suitable language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

In this regard, in some embodiments, the controller 472 may be configured to execute computer program code instructions to perform aspects of various embodiments of the present invention described herein. For example, the controller 472 may be configured to control opening and closing of the dispense valve 420, such as for predetermined time periods. In some embodiments, the controller 472 may be configured to determine when user input is received indicating a desire to cause a dispense (such as to the activation sensor 475) and, in response, cause the dispense valve 420 to open for the predetermined period of time. In some embodiments, the controller 472 may be configured to count the number of dispenses, which may correspond to one or more of the first and second reservoirs 452, 454 such that an amount of remaining skin care product composition within the reservoir may be determined. In some embodiments, such data and other data can be monitored and transmitted (e.g., via the controller 472), such as through the communication interface 476 to a remote device. In some embodiments, the controller 472 may be configured to perform various other functions, such as through interaction with various other components (e.g., the power supply 477 (e.g., monitor power supply), the user interface 478, etc.).

The memory 474 may be configured to store instructions, computer program code, usage data, and other data/information associated with the dispenser 300 in a non-transitory computer readable medium for use, such as by the controller 472.

The communication interface 476 may be configured to enable connection to external systems (e.g., remote system(s)/device(s)). In some embodiments, the communication interface 476 may comprise one or more transmitters configured to transmit, for example, one or more signals according to example embodiments described herein. Likewise, the communication interface 476 may include at least one receiver configured to, for example, receive data according to example embodiments described herein. In some embodiments, the transmitter and receiver may be combined as a transceiver. In this regard, the dispenser 400 may be configured for wired and/or wireless communication. In some embodiments, the communication interface 476 may comprise wireless capabilities for WiFi, Bluetooth, low-power wide-area network (LPWAN), or other wireless protocols.

The user interface 478 may be configured to receive input from a user and/or provide output to a user. The user interface 478 may include, for example, a display, a keyboard, keypad, function keys, mouse, scrolling device, input/output ports, touch screen, or any other mechanism by which a user may interface with the system. Although the user interface 478 is shown as being directly connected to the controller 472 and within the dispenser 400, the user interface 478 could alternatively be remote from the controller 472 and/or dispenser 400. Likewise, in some embodiments, other components of the dispenser 400 could be remotely located.

The activation sensor 475 may be configured to receive user input indicating a desire to initiate a dispense of the skin care product. In some embodiments, the activation sensor 475 may be configured to detect a presence of an object, such as a hand of a user. The activation sensor 475 may be any type of sensor, such as a capacitive sensor, a pressure sensor, a time-of-flight sensor, an infrared sensor, etc. In some embodiments, the activation sensor may be a mechanism or other mechanical sensor or feature, such as a lever or a button. The activation sensor 475 may be in communication with the controller 472 and configured to transmit sensor data to the controller 472 for use thereof.

The power supply 477 may include an internal and/or external power supply that is configured to supply power to various components of the dispenser 400 (e.g., the dispense valve 420, the user interface 478, etc.). In some embodiments, the power supply 477 may include one or more batteries, which may be replaced and/or recharged. In some embodiments, the power supply 477 may be an external power supply, such as a wall outlet.

The dispenser 400 may include other system(s)/sensor(s) 479 that may be configured to perform various functions, such as monitoring or measuring—which may be used with embodiments described herein. For example, the dispenser 400 may include a reservoir replacement switch and/or sensor that is configured to detect when a new reservoir is positioned within the dispenser 400 (e.g., replacing an empty reservoir). In some embodiments, the switch/sensor may be configured to receive user input indicating that a new reservoir (e.g., the first and/or second reservoir 452, 454) has been installed. In some embodiments, the switch/sensor may detect, such as through detecting the connection of the reservoir to the housing and/or through a non-touch sense (e.g., light, capacitance, etc.). As another example, the dispenser 400 may include a cover switch or sensor that is configured to determine when a cover of a housing of the dispenser 400 is opened and/or closed. As appreciated based on the various embodiments described herein, other system(s)/sensor(s) 479 are contemplated.

FIG. 9 shows a detailed view of a portion of an example foam skin care product dispenser including two reservoirs, such as may correspond to the example embodiments described with respect to FIG. 8. A first connector 564 is configured to removably attach to a first reservoir. A first flow structure 582 leads from the first connector 564 to a first check valve 534. A second flow path structure 586 leads from the first check valve 534 to a T-manifold 515 (e.g., which may include a switch). A second connector 566 is configured to removably attach to a second reservoir. A third flow path structure 584 leads from the second connector 566 to a second check valve 546. A fourth flow path structure 588 leads from the second check valve 536 to the T-manifold 515. A dispense valve 520 is attached to the T-manifold 515 and can be opened to enable fluid within the T-manifold to flow therethrough to a fifth flow path structure 592. Notably, while it may be difficult to tell from FIG. 9, the first connector 564 and the second connector 566 are separate components in the illustrated embodiment (although in some embodiments, the first and second connectors could be attached together in some form).

FIG. 10 illustrates a cross-sectional view of an example male-type connector for attachment of a reservoir. For example, the connector 564 includes a main body 563 that defines a fluid pathway 568 with an inlet 565 and an outlet 567. The main body 563 includes a reservoir attachment portion 561 that includes connection features for removably receiving and attaching to a reservoir. Notably, when attached, the reservoir attachment portion 561 may be configured to transition the reservoir to an open configuration, with an O-ring 569 forming a seal around a stem of the reservoir (not shown). The main body 563 also includes a flow path structure attachment portion 599 that includes connection features for removably receiving and attaching to a flow path structure (e.g., a tube).

Example Flow Path Dispense Control Systems

In some embodiments, one or more features/components may be added to the system to control dispensing through the flow path structures, the dispense valve, and/or the dispensing outlet during or after a dispense occurs (e.g., to flush out the line, ensure that there is not extra run-off that trickles out of the dispensing outlet, etc.). In this regard, in some cases, dispensing of the foam skin care product may cause residue to build-up in one or more components (e.g., flow path structure(s), the dispense valve, etc.). In some embodiments, various components/features can be used to further control the dispense, such as flush the flow path structures, the dispense valve, and/or the dispensing outlet during or after a dispense occurs. Such features may provide, for example, the benefit of clearing the dispense valve of residue to reduce the potential for clogging due to build-up over time. Similarly, such features may provide, for example, the benefit of clearing the flow path structures in conjunction with a dispense (e.g., simultaneously or right after the dispense) to cause full evacuation of the skin care product composition for the dispense, such as in order to avoid a slow trailing "snake" of foam that oozes out after the main dispense occurs.

FIGS. 11A-C illustrate schematic diagrams of some such example dispenser systems. For example, in some embodiments, a flush valve (e.g., a second solenoid or metered valve) may be positioned proximate the dispensing outlet and can be shut off to prevent leaking out of the dispensing outlet (see e.g., FIG. 11A). In another example embodiment, an air pump (e.g., air piston) may be provided to flush air through the flow path structures, the dispense valve, and/or the dispensing outlet to ensure a complete dispense and clear the lines (see e.g., FIG. 11B). In yet another example embodiment, a flush composition (e.g., from a dedicated flush reservoir) may be fed into the flow path structures, the dispense valve, and/or the dispensing outlet to ensure a complete dispense and clear the lines (see e.g., FIG. 11C). Such example dispensers and corresponding components/features are just some examples contemplated herein.

FIGS. 11A-C illustrates a schematic diagram of an example dispenser system that can be utilized by various example embodiments of the present invention. Notably, while many of the components and features are similar to the dispenser 300 described with respect to FIG. 7, one notable addition is that the dispensers 900, 900', 900" use one or more additional flow control components to help control the dispensing pathway in conjunction with or after a dispense. While the example dispensers 900, 900', 900" are shown with only one reservoir, such example dispensers can be utilized with a dispenser using multiple reservoirs, such as similar to the dispenser 400 described with respect to FIG. 8.

The foam skin care product (e.g., soap) dispenser 900, 900', 900" may include components corresponding to various embodiments described herein (such as the components described with respect to FIGS. 7 and 8 where appropriate). The example dispenser 900, 900', 900" may comprise hardware and/or software capable of performing functions described herein. In this regard, the dispenser 900, 900', 900" may include a controller 972, a memory 974, a communication interface 976, a user interface 978, an activation sensor 975, a power supply 977, other system(s)/sensor(s) 979, a reservoir 952, a check valve 934, a dispense valve 920, a dispense outlet 912, and flow path structures 982, 986, 992, 992*a*, 992*b*, as illustrated. Notably, each of the components/features may be configured and/or operate as detailed herein, such as with respect to the corresponding components/features shown and described with respect to FIGS. 7 and 8. In addition, though not shown here, various other components may be included in example dispensers 900, 900', 900", such as various sensors, additional flow path structures, additional reservoirs, check valves, and chambers.

Notably, the example dispenser 900, 900', 900" shown in each of FIGS. 11A, 11B, and 11C, respectively, each include one or more flow control components to help control the dispensing pathway in conjunction with or after a dispense.

FIG. 11A illustrates an example dispenser 900 that includes a flush valve 941 that is positioned along the dispensing pathway downstream of the dispense valve 920, such as between flow path structures 992*a* and 992*b*. In some embodiments, the flush valve 941 may comprise a valve, such as a solenoid valve or metered valve, that can move between a closed position (where flow is restricted) and an open position (where flow is enabled). The controller 972 may be configured to operate the flush valve 941 to move the flush valve 941 between the open and closed positions. In some embodiments, the flush valve 941 is positioned proximate the dispensing outlet 912 (such as within 2 inches) of the dispensing outlet 912. In this regard, the controller 972 may shut off the flush valve 941 (e.g., move it to the closed position) right after occurrence of the dispense—which may prevent excess remaining foam or liquid residue from passing out of the dispensing outlet 912, such as a slow trailing "snake" of foam that oozes out (which may be otherwise negatively perceived by an end user).

FIG. 11B illustrates another example dispenser 900' that includes an air pump 943 that is positioned to provide air 947*b* along the dispensing pathway downstream of the dispense valve 920, such as along flow path structure 992. Notably, however, the air pump 943 may be positioned elsewhere along the dispensing pathway, such as before the dispense valve 920. A mechanism (e.g., a motor with gears or other known structure) may be configured to operate the air pump 943, such as in response to signals from the controller 972. In this regard, the controller 972 may operate the mechanism to cause the air pump 943 to pump air (such as from the nearby environment 947*a*) into the dispensing pathway, such as into flow path structure 992 along 947*b*. Such air may cause excess residue of the skin care product in the flow path structures to evacuate out through the dispensing outlet 912. Depending on when the controller 972 operates the air pump 943, such as in conjunction with a dispense, the air provided by the pump may help ensure full evacuation of the released skin care product. Further, such full evacuating may occur simultaneously or near simultaneously with the dispense so as to avoid, for example, a slow trailing "snake" of foam that oozes out after the dispense occurs.

FIG. 11C illustrates another example dispenser 900" that includes a flush reservoir 944 that holds a fluid (such as propellant and/or water) and a flush valve 946 that controls introduction of the fluid at a position along the dispensing pathway downstream of the dispense valve 920, such as along flow path structure 992. Notably, however, the flush valve 946 may be positioned to provide the fluid from the flush reservoir 944 elsewhere along the dispensing pathway, such as before the dispense valve 920. In some embodiments, the flush valve 946 may comprise a valve, such as a solenoid valve or metered valve, that can move between a closed position (where flow is restricted) and an open position (where flow is enabled). The flush reservoir 944 may be any type of structure capable of holding fluid and providing it to the flush valve 946. In some embodiments, the flush reservoir 944 may be replaceable and/or refillable. The controller 972 may operate the flush valve 946 to cause the fluid from the flush reservoir 944 to pass into the dispensing pathway, such as into flow path structure 992. Such fluid may cause excess residue of the skin care product in the flow path structures to evacuate out through the dispensing outlet 912. Depending on when the controller 972 operates the flush valve 946, such as in conjunction with a dispense, the propellant provided may help ensure full evacuation of the released skin care product. Further, such full evacuating may occur simultaneously or near simultaneously with the dispense so as to avoid, for example, a slow trailing "snake" of foam that oozes out after the dispense occurs.

Example Flowcharts

Embodiments of the present invention provide methods, apparatuses and computer program products for providing dispensing of foam skin care product according to various embodiments described herein. Various examples of the operations performed in accordance with embodiments of the present invention will now be provided with reference to FIG. 12.

FIG. 12 illustrates a flowchart according to an example method for a dispenser according to example embodiments described herein. The operations illustrated in and described with respect to FIG. 12 may, for example, be performed by, with the assistance of, and/or under the control of one or more of the components and/or systems/devices of example dispensers described herein, such as dispensers 100, 200, 300, 400, 600, 700, 900, 900', and 900".

The method 800 may include sensing user input provided to an activation sensor at operation 802. At operation 804, the method may include controlling a dispense valve for a predetermined amount of time to release skin care product composition to perform a dispense of a portion of skin care product composition to form foamed skin care product that dispenses through a dispensing outlet. In some embodiments, at operation 806, the method may include utilizing a flow control component (e.g., a flush valve 941, an air pump 943, or a flush valve 946 for a flush reservoir 944). In this regard, the method may include controlling the flow control component to control flow (such as described herein) within the flow path structure(s) and/or valve(s) after and/or in conjunction with occurrence of a dispense.

FIG. 12 illustrates an example flowchart of a system, method, and computer program product according to various example embodiments described herein. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory and executed by, for example, the controller(s) described herein. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

Example 1

Skin care product compositions were produced according to the ingredient list and weight percent concentrations provided in Tables 1 and 2, below. The compositions each contained a low boiling point solvent which also acts as a propellant, making them appropriate for use in a single reservoir dispenser.

TABLE 1

| Composition | WT % of the Composition Formula No. 1 | 2 | 3 | 4 | 5 |
|---|---|---|---|---|---|
| Water | QS | QS | QS | QS | QS |
| Ammonium Laureth Sulfate | 10.0 | 10.0 | 10.0 | 10.0 | 10.0 |
| Lauryl Glucoside | 10.0 | 10.0 | 10.0 | 10.0 | 10.0 |
| PEG-120 Methyl Glucose Dioleate | 1.0 | 1.0 | 1.0 | 1.0 | 1.0 |
| Kathon CG | 0.08 | 0.08 | 0.08 | 0.08 | 0.08 |
| HFC - 152a | | 5.0 | 10.0 | 15.0 | 5.0 |
| HFC - 134a | | | | | |
| Dimethyl ether (35% solution in water) | 5.0 | | | | 5.0 |
| Concentration relative to current commercial standards | 4 | 4 | 4 | 4 | 4 |

TABLE 2

| Composition | WT % of the Composition Formula No. 6 | 7 | 8 | 9 | 10 | 11 |
|---|---|---|---|---|---|---|
| Water | QS | QS | QS | QS | QS | QS |
| Ammonium Laureth Sulfate | 10.0 | 10.0 | 10.0 | 15.0 | 15.0 | 15.0 |
| Lauryl Glucoside | 10.0 | 10.0 | 10.0 | 15.0 | 15.0 | 15.0 |
| PEG-120 Methyl Glucose Dioleate | 1.0 | 1.0 | 1.0 | 1.0 | 1.0 | 1.0 |
| Kathon CG | 0.08 | 0.08 | 0.08 | 0.08 | 0.08 | 0.8 |
| HFC - 152a | 10.0 | 15.0 | | 15.0 | 20.0 | 10.0 |
| HFC - 134a | | | 20.0 | | | |
| Dimethyl ether (35% solution in water) | 5.0 | 5.0 | | 5.0 | | 5.0 |
| Concentration relative to current commercial standard | 4 | 4 | 4 | 6 | 6 | 6 |

Example 2

Skin care concentrates and skin care product compositions were produced according to the ingredient list and weight percent concentrations provided in Table 3, below. The skin care product compositions performed well, blooming to an acceptable volume upon dispersal and providing an acceptable amount of surfactant for cleansing purposes. The dried form of the skin care product composition remained waxy and did not crystallize, which is beneficial to avoid bridging and/or clogging.

TABLE 3

| Ingredient | Weight Percentage in Concentrate | Weight Percentage in Skin Care Product Composition |
|---|---|---|
| Water | 88.82 | 78.16 |
| Sodium Lauroyl Sarcosinate | 7.63 | 6.71 |
| Lauryl Betaine | 2.00 | 1.76 |
| Sodium Benzoate | 0.20 | 0.18 |
| Glycerine | 1.00 | 0.88 |
| Aminomethylpropanol | 0.30 | 0.26 |
| Kathon CG | 0.05 | 0.04 |

TABLE 3-continued

| Ingredient | Weight Percentage in Concentrate | Weight Percentage in Skin Care Product Composition |
|---|---|---|
| Isobutane | n/a | 3.00 |
| Dimethyl Ether | n/a | 9.00 |

The surfactants in the skin care concentrate and skin care product composition comprise sodium lauroyl sarcosinate and lauryl betaine. In this example, sodium lauroyl sarcosinate was selected as a surfactant, in part, because it is mild on the skin and has a good foaming effect in combination with the selected propellants. Sodium lauroyl sarcosinate may lower the surface tension between liquids or gas/liquid phases, may provide a detergent effect, may serve as a foaming agent, wetting agent, emulsifier, and/or dispersant. In this example, lauryl betaine was included as a secondary surfactant, in part, because it aids in incorporating the propellant into the skin care concentrate. Additionally, lauryl betaine dries in a waxy form, which aids in avoiding bridging and/or clogging in the dispensing equipment. Other surfactants could be substituted into the skin care concentrate and/or skin care product composition.

In this example, the weight percentage of surfactant in the skin care concentrate is 9.63% and the weight percentage of surfactant in the skin care product composition is 8.47%. These surfactant concentrations are significantly higher than typical surfactant concentrations in comparative products, which may instead be in the range of about 2%, by weight. In an embodiment, the skin care product of Example 2 delivers between about 0.02 g and about 0.03 g of surfactant per dose. In another embodiment, the skin care product of Example 2 delivers about 0.023 g of surfactant per dose.

The propellants in this skin care product composition comprise isobutane and dimethyl ether. In this example, the isobutane is not soluble with the skin care concentrate and the skin care product composition exists in a liquid/vapor phase within the dispenser. The isobutane may float above the surface of the liquid skin care concentrate in an embodiment. In an embodiment, the dimethyl ether may partially dissolve in the skin care concentrate. In an embodiment, about 10% to about 30% of the dimethyl ether may dissolve in the skin care concentrate. In an embodiment, the choice of surfactant and/or the amount of surfactant in the skin care concentrate may increase the dissolution of the dimethyl ether into the skin care product composition.

The inventors have advantageously discovered that use of the propellant combination of isobutane and dimethyl ether in the skin care product composition provides a luxurious foam which blooms to multiple times its original volume upon entering atmospheric pressure. In an embodiment, the propellant combination of isobutane and dimethyl ether, in combination with one or more surfactants in the skin care product composition, causes the skin care product composition to bloom to at least twice its original volume upon entering atmospheric pressure. It is believed that the inclusion of dimethyl ether in the propellant component of the skin care product composition allows the foam to retain its volume without quickly collapsing. In this example, the percentage of propellant in the skin care product composition is 12%, which is higher than known compositions which may have a propellant percentage in the final composition of only about 5% to about 6%.

In an embodiment, glycerine aids in ensuring that the skin care product composition does not crystalize and instead dries in a waxy form, to avoid bridging and/or clogging. In an embodiment, glycerine aids in ensuring that the skin care product composition produces a lubricious and moisturizing effect on the skin. In an embodiment, however, glycerine could be omitted from the skin care concentrate and skin care product composition. In an embodiment, however, glycerine could be omitted from the skin care concentrate and skin care product composition.

In an embodiment, any one or any combination of the following components could be omitted from the skin care concentrate or the skin care product composition and/or substituted with other components (e.g. alternative pH adjusters, humectants, moisturizers, preservatives, etc.): sodium benzoate, glycerine, aminomethylpropanol, and/or Kathon CG.

In an embodiment, the shot or dose size of the skin care product composition of Example 2 is about 0.2 g to about 0.3 g, which then blooms to several times its volume. In a particular embodiment, the shot or dose size of the skin care product composition of Example 2 is about 0.25 g, which then blooms to several times its volume. This shot or dosage size is significantly smaller than that dispensed in comparative hand soaps, which may be about 0.7 g. This provides a significant benefit in terms of number of doses per dispenser, refill frequency, size of dispenser, and other benefits discussed herein. In addition, the skin care product composition of the invention can deliver up to fifty percent (50%) more surfactant to a user than the commercially available foam hand soap compositions.

In an embodiment, a dose of skin care product composition (which comprises about 0.2 g to about 0.3 g and, in some embodiments, about 0.25 g) foams to form a skin care product which comprises about 5 cc to about 9 cc of foam. In an embodiment, the skin care product composition (which comprises about 0.2 g to about 0.3 g and, in some embodiments, about 0.25 g) foams to form a skin care product which comprises about 7 cc of foam. In an embodiment, a dose of skin care product composition (which may comprise about 0.2 g to about 0.3 g and, in some embodiments, about 0.25 g) foams to form a skin care product which comprises about 7 mL to about 12 mL of foam. In an embodiment, due to the propellant components, a dose of skin care product composition (which may comprise about 0.2 g to about 0.3 g and, in some embodiments, about 0.25 g) foams to form a skin care product which comprises about 10 mL of foam.

In an embodiment, the skin care product composition of Example 2 is dispensed from a tin-plated steel reservoir. If an aluminum reservoir is utilized, sodium benzoate and aminomethylpropanol may be reduced, removed or substituted by another component or combination of components (i.e. preservative and pH adjuster) in the skin care product composition. The pH may be adjusted to a range suitable for aluminum using citric acid, for example.

The skin care concentrate of Example 2 was formed via charging about 5% of the total final volume of purified water to a pre-mix vessel. Sodium benzoate was then added to the pre-mix vessel and mixed until the mixture was uniform. About 90% of the total purified water volume was then charged to a main mix tank (5% was reserved for rinsing the pre-mix vessel). Sodium lauroyl sarcosinate, lauryl betaine, and glycerine were added to the main mix tank. The mixture was mixed until uniform. The pre-mix mixture (water and sodium benzoate) was then transferred to the main mix tank. The pre-mix vessel was rinsed using the reserved 5% of the total final volume of purified water. The rinse was deposited into the main mix tank. Kathon CG was also added to the main mix tank. The combination was then mixed in the main mix tank until uniform. Aminomethylpropanol was added to the main mix tank, on an as-needed basis, to reach a target pH of about 10.8 to form the skin care concentrate.

The skin care concentrate was then charged to a skin care reservoir as set forth herein (approximately 575 g of concentrate). A valve with a diptube and seat was inserted on the rolled lip of the reservoir. The valve was crimped to the specifications of the reservoir. About 75 g of the propellant blend (isobutane and dimethyl ether) was added to the reservoir via the valve. The reservoir was then passed through a hot water bath to ensure proper assembly and internal pressure. The reservoir was then dried and a protective overcap was applied.

Other ingredient combinations may be viable in the invention. For example, one or more propellants of the invention may be used in connection with a concentrate which may comprise denatured alcohol, lauramine oxide, sodium laureth sulfate, sodium lauryl sulfate, methylisothiazolinone, phenoxyethanol, PPG-26, isopropylideneglycerol, and sodium xylenesulfonate in an embodiment. In this embodiment, the propellants may be solubilized to maintain them in the liquid phase.

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A foam skin care product dispenser configured for mounting to a counter, wherein the foam skin care product dispenser comprises:

a dispensing spout positioned above the counter, wherein the dispensing spout comprises a dispensing outlet;

an undercounter receiving portion configured to removably receive a reservoir, wherein the reservoir is configured to hold, under pressure, a foamable skin care product composition, wherein the skin care composition includes at least one surfactant and at least one propellant;

an activation sensor configured to detect a user;

a flow path leading to the dispensing outlet;

a dispense valve in fluid communication with the reservoir and the flow path, wherein the dispense valve is movable between an open configuration and a closed configuration; and a controller configured to cause, in response to the activation sensor detecting the user, the dispense valve to move to the open configuration to release a portion of the skin care product composition under the pressure of the reservoir into the flow path downstream of the dispense valve;

wherein the portion of the skin care product composition is configured to, after being released through the dispense valve, form a foamed skin care product that dispenses through the dispensing outlet.

2. The foam skin care product dispenser of claim 1, wherein the dispense valve is one of a solenoid valve or a metered valve.

3. The foam skin care product dispenser of claim 1, wherein a portion of the flow path leading from the dispense valve to the dispensing outlet defines a length of at least 100 mm.

4. The foam skin care product dispenser of claim 1, wherein the portion of the skin care product composition released through the dispense valve is within a range of about 0.2 grams to about 0.3 grams.

5. The foam skin care product dispenser of claim 1, wherein the undercounter receiving portion comprises a receiving valve configured to extend into an installed reservoir and cause the reservoir to be in a released state such that the skin care product composition enters a portion of the flow path leading to the dispense valve.

6. The foam skin care product dispenser of claim 5, wherein the reservoir defines a female outlet valve for receiving a portion of the receiving valve of the undercounter receiving portion.

7. The foam skin care product dispenser of claim 1, wherein the reservoir includes an adapter configured to be removably mounted to the undercounter receiving portion.

8. The foam skin care product dispenser of claim 7, wherein the adapter defines a top wall that interacts with the undercounter receiving portion to ensure a desired installation position of the reservoir.

9. The foam skin care product dispenser of claim 8, wherein the adapter is configured to be removably mounted to the undercounter receiving portion via a threaded connection.

10. The foam skin care product dispenser of claim 8, wherein the adapter is configured to be removably mounted to the undercounter receiving portion via one or more snap features.

11. The foam skin care product dispenser of claim 1 further comprising a check valve positioned along the flow path between the reservoir and the dispense valve, wherein the check valve is configured to enable liquid from the reservoir to pass through the check valve along a flow direction leading to the dispense valve and prevent liquid from passing back through the check valve in a direction opposite to the flow direction.

12. The foam skin care product dispenser of claim 1, wherein the reservoir is configured to maintain a constant pressure between dispenses such that there is a constant flow rate through the dispense valve.

13. The foam skin care product dispenser of claim 1 further comprising a communication interface configured to communicate with a remote device, wherein the controller is configured to monitor usage data corresponding to the skin care product dispenser and transmit the usage data via the communication interface to the remote device.

14. The foam skin care product dispenser of claim 1 further comprising a flush valve positioned along the flow path downstream of the dispense valve and configured to close following a dispense occurrence to prevent leaking of residue out of the dispensing outlet.

15. The foam skin care product dispenser of claim 1 further comprising an air pump configured to provide air to the flow path downstream of the dispense valve after or in conjunction with the occurrence of a dispense to aid in full evacuation of the released skin care product through the dispensing outlet.

16. The foam skin care product dispenser of claim 1 further comprising a flush valve configured to provide fluid from a flush reservoir to the flow path downstream of the dispense valve after or in conjunction with the occurrence of a dispense to aid in full evacuation of the released skin care product through the dispensing outlet.

* * * * *